US007028741B2

(12) United States Patent
Coenraets

(10) Patent No.: US 7,028,741 B2
(45) Date of Patent: Apr. 18, 2006

(54) SHUTTER DEVICE FOR CLOSING AN APERTURE

(76) Inventor: Benoit Coenraets, Chaussee de Waterloo, 496 D, Brussels (BE) 1050

( * ) Notice: Subject to any disclaimer, the term of this patent is extended or adjusted under 35 U.S.C. 154(b) by 0 days.

(21) Appl. No.: 10/381,429

(22) PCT Filed: Sep. 13, 2001

(86) PCT No.: PCT/BE01/00154

§ 371 (c)(1),
(2), (4) Date: Sep. 2, 2003

(87) PCT Pub. No.: WO02/25048

PCT Pub. Date: Mar. 28, 2002

(65) Prior Publication Data

US 2004/0020611 A1 Feb. 5, 2004

(30) Foreign Application Priority Data

Sep. 25, 2000 (EP) ..... 00120844

(51) Int. Cl.
*E06B 9/56* (2006.01)

(52) U.S. Cl. ..... 160/273.1; 160/271

(58) Field of Classification Search ..... 160/270, 160/273.1, 310, 272, 271
See application file for complete search history.

(56) References Cited

U.S. PATENT DOCUMENTS 1,694,314 A * 12/1928 Dixson ..... 160/273.1
1,786,054 A * 12/1930 Dixson ..... 160/273.1
5,477,902 A * 12/1995 Kraeutler ..... 160/84.06
5,526,865 A * 6/1996 Coenraets ..... 160/272
5,944,086 A * 8/1999 Gruben et al. ..... 160/266
6,119,758 A 9/2000 Coenraets

FOREIGN PATENT DOCUMENTS

WO WO 95/30064 11/1995

* cited by examiner

*Primary Examiner*—Blair M. Johnson
(74) *Attorney, Agent, or Firm*—Browdy and Neimark, PLLC

(57) ABSTRACT

The invention concerns a shutter device (1) in particular for closing an aperture (3) or the like, by displacement of the shutter (1) relative to one or several guide paths (7, 8), wherein the transmission means (5, 6) co-operating with the guide paths (7, 8), are provided between the lateral edges (9, 10) of the shutter (1) and the guide paths (7, 8) such that when a certain tractive force transverse to the longitudinal direction of the guide paths (7, 8) is exerted on the lateral edges (9, 10) of the shutter (1), said edges (9, 10) are separated at least partly from said transmission means (5, 6).

23 Claims, 19 Drawing Sheets

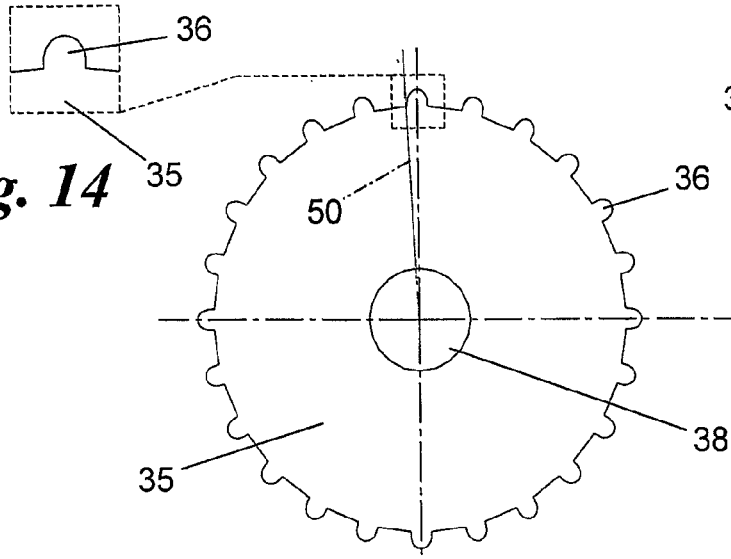
Fig. 14
Fig. 12
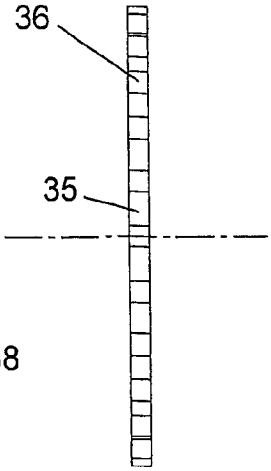
Fig. 13
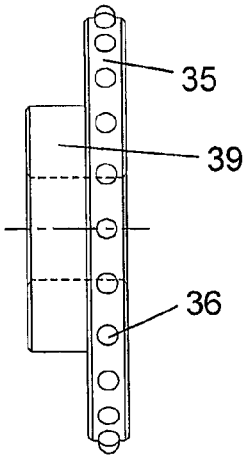
Fig. 16
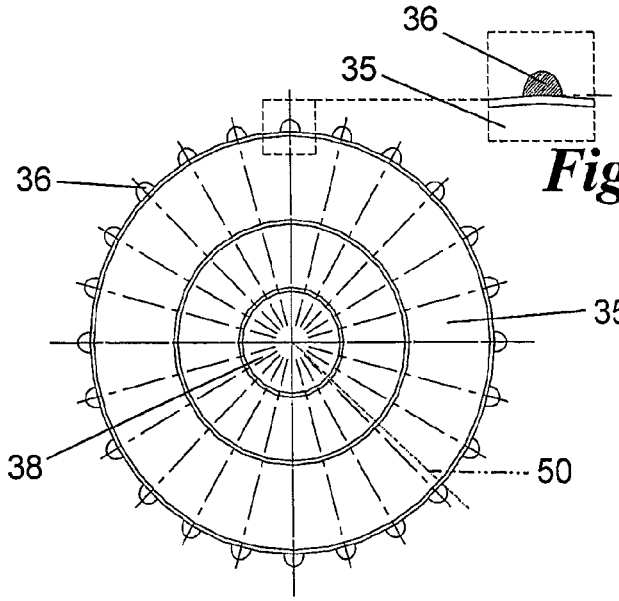
Fig. 17
Fig. 15

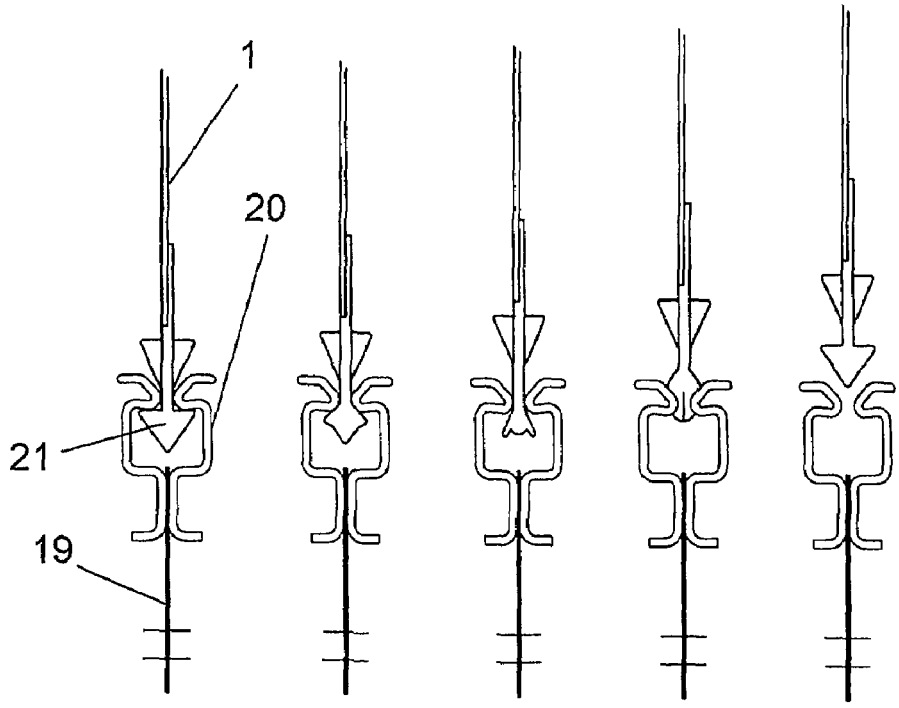
*Fig. 38* *Fig. 39* *Fig. 40* *Fig. 41* *Fig. 42*
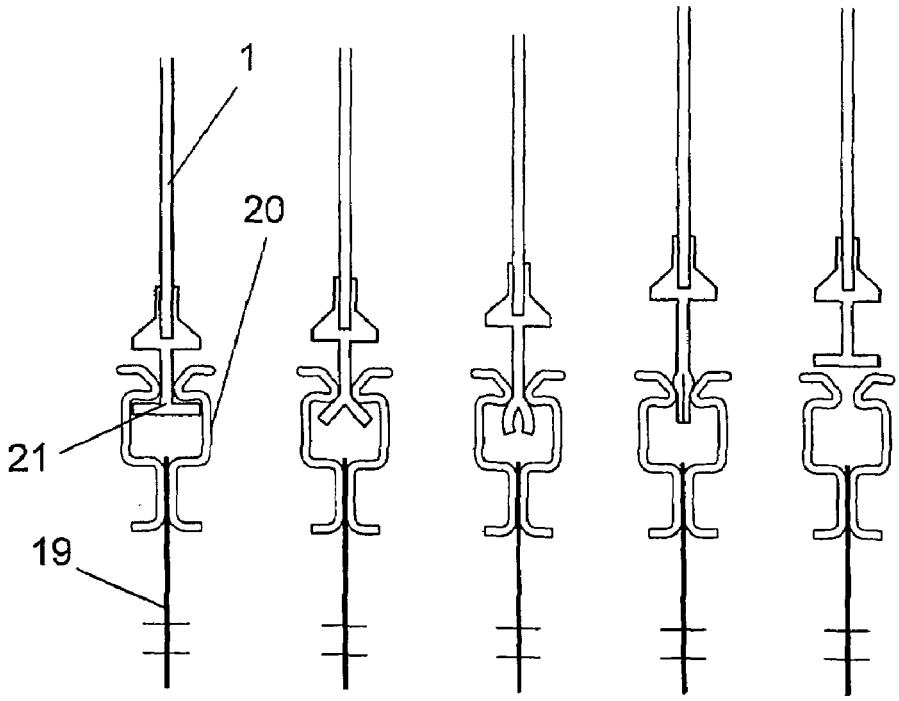
*Fig. 43* *Fig. 44* *Fig. 45* *Fig. 46* *Fig. 47*

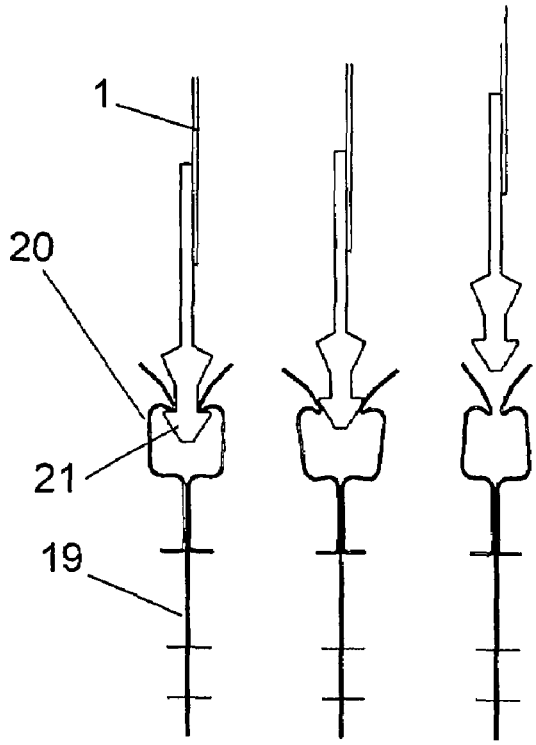
*Fig. 48* *Fig. 49* *Fig. 50*
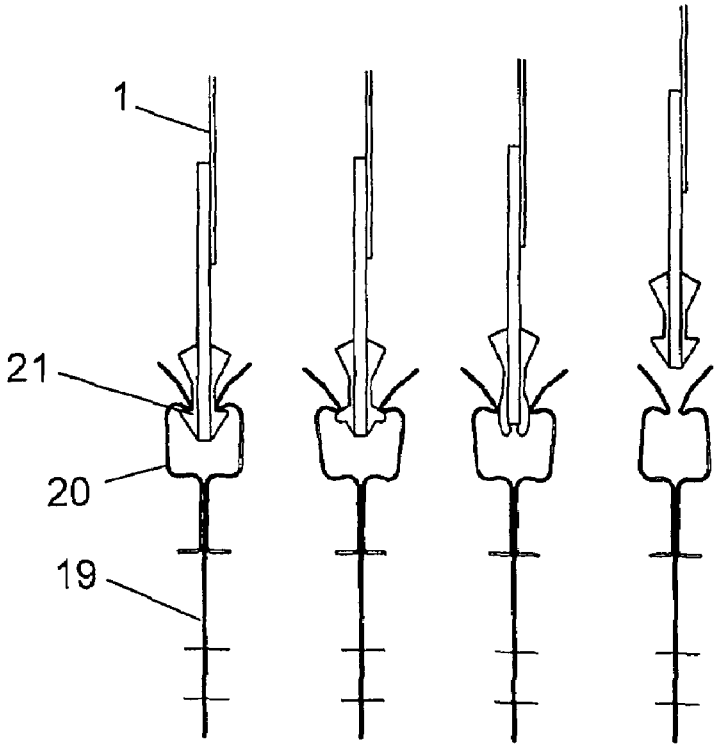
*Fig. 51* *Fig. 52* *Fig. 53* *Fig. 54*

SHUTTER DEVICE FOR CLOSING AN APERTURE

The invention relates to a shutter device, designed in particular for closing off an opening or any other opening by displacing the shutter relative to guide tracks.

Publications WO95/30064, EP 0 272 733 and EP 0 587 586 describe a closure device in which the side edges of the shutter are guided in guide tracks. When a traction force is exerted on the edges of the shutter transverse to the longitudinal direction, the latter releases from the guide tracks. In this type of device, the side edges of the shutter may become damaged as they are released, necessitating repair, which incurs considerable dismantling costs. Furthermore, the shutter makes a noise as it is displaced in the guide tracks.

One of the essential objectives of the present invention is to propose a device which allows the disadvantages outlined above to be overcome, whilst being simple in design and construction and affording perfect reliability. Accordingly, the device proposed by the invention is susceptible to very much less wear than the devices of the prior art and causes much less noise. It is also worth noting that very little friction occurs in the guide tracks when the shutter is displaced, which means that the device proposed by the invention consumes much less energy.

To this end, for the purposes of the invention, transmission means are inserted between the side edges of the shutter and the guide tracks and are secured to the side edges of the shutter so that when a certain amount of traction force is exerted on the side edges of the shutter relative to the guide tracks transversely to the longitudinal direction of the guide tracks, these edges are at least partially separated from the latter.

Advantageously, the transmission means are fixed to the side edges of the shutter by hooking means.

In one specific embodiment of the invention, the shutter has side edges projecting out from the plane of the shutter, these edges being clamped by said transmission means.

In one particularly advantageous embodiment of the invention, the transmission means have a succession of recesses spaced apart in the direction of displacement of the shutter, which co-operate with driving means enabling the shutter to be displaced in the direction of the guide tracks.

The driving means preferably comprise a toothed wheel, the teeth of which are spaced apart from one another to enable them to co-operate with the recesses of the transmission means.

In a preferred embodiment of the invention, re-locating means are provided in order to restore the link between the transmission means and the shutter if the latter becomes separated from the transmission means as it is being opened or closed, the re-locating means comprising members which exert a compression force on the side edges of the shutter.

Other details and features of the invention will become clear from the following description, which is given by way of illustration and is not restrictive in any respect, of specific embodiments of the invention with reference to the appended drawings.

FIG. 12 is a schematic front view of one specific embodiment of a toothed wheel as proposed by the invention.

FIG. 13 is a schematic side view of the toothed wheel illustrated in FIG. 12.

FIG. 14 is a detailed illustration on a larger scale of a tooth of the toothed wheel illustrated in FIG. 12.

FIG. 15 is a schematic front view of another specific embodiment of a toothed wheel as proposed by the invention.

FIG. 16 is a schematic side view of the toothed wheel illustrated in FIG. 16.

FIG. 17 is a detailed illustration on a larger scale of a tooth of the toothed wheel illustrated in FIG. 15.

FIGS. 38 to 42 illustrate successive stages in the deformation of a specific bead when the shutter becomes separated from the transmission means.

FIGS. 43 to 47 illustrate successive stages in the deformation of another specific embodiment when the shutter becomes separated from the transmission means.

FIGS. 48 to 50 illustrate successive stages in the deformation of a clip when the shutter becomes separated from the transmission means.

FIGS. 51 to 54 illustrate successive steps in the deformation of a clip and a bead when the shutter becomes separated from the transmission means.

The same reference numbers are used to denote the same elements or similar elements in the various drawings.

Figure 1:
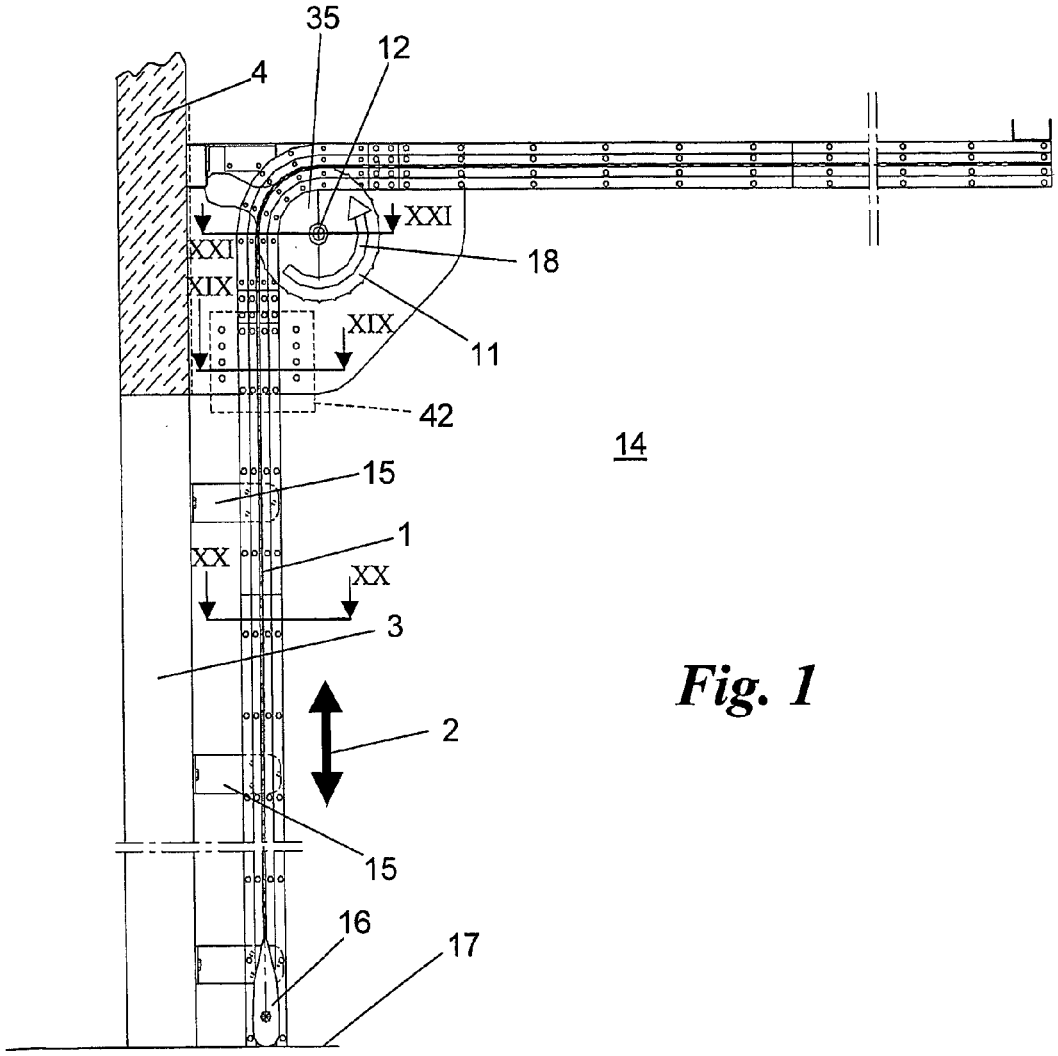
FIG. 1 is a schematic side view in section with partial cutaways of one particular embodiment of a shutter device as proposed by the invention.
Figure 2:
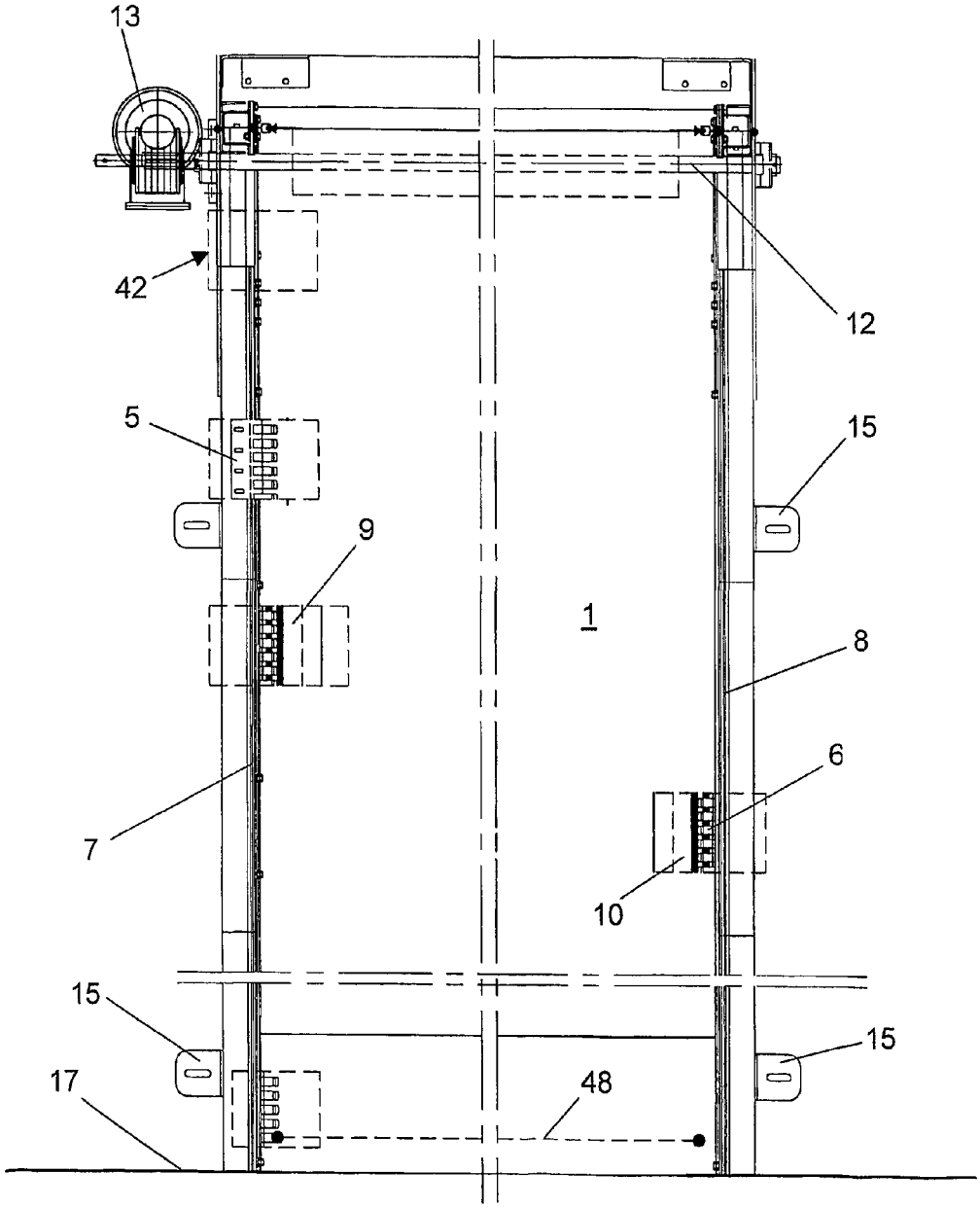
FIG. 2 is a schematic front view of a shutter device proposed by the invention, seen in elevation, with several part sections.

As illustrated in FIGS. 1 and 2, the device proposed by the invention comprises a shutter 1 which may be displaced in the direction of arrow 2 between a closed position and an open position, designed to close off a n opening 3 or any other opening or passage in a wall 4. In FIGS. 1 and 2, the device is illustrated in its closed position with the free edge 16 of the shutter 1 against the ground 17.

By the word "shutter" within the context of the present invention is meant any element that is at least partially flexible, rigid or semi-rigid, such as a tarpaulin, a strip of plastics material, an assembly of articulated plates, a grille, etc. . . .

However, it should be pointed out that preference is given to shutters of the flexible type formed by a tarpaulin. Accordingly, the drawings show a shutter consisting of a tarpaulin 1, the side edges 9 and 10 of which are provided in the form of a strip, optionally made from a different material, which might be flexible in its longitudinal direction only, for example. This strip is fixed to the tarpaulin by bonding, welding or any other means.

The shutter 1 is guided by transmission means 5 and 6 in guide tracks 7 and 8 which have a vertical part on either side of the opening 3 and a part extending substantially horizontally at a level located above the opening 3. When the shutter 1 is opened, it is displaced from the vertical part of the guide tracks 7 and 8 as far as the horizontal part to permit access through the opening 3. The guide tracks 7 and 8 are fixed to the wall 4 by angle sections 15.

The transmission means 5 and 6 co-operate with driving means so as to be able to displace the shutter 1 in the direction of arrow 2. These driving means comprise two toothed wheels 35, disposed adjacent to two side edges 9 and 10 of the shutter 1, having a common rotation shaft 12. This latter is driven by an electric motor 13. The opening 3 is closed off by the shutter 1 by rotating the toothed wheels in the direction of arrow 18.

Figure 3:
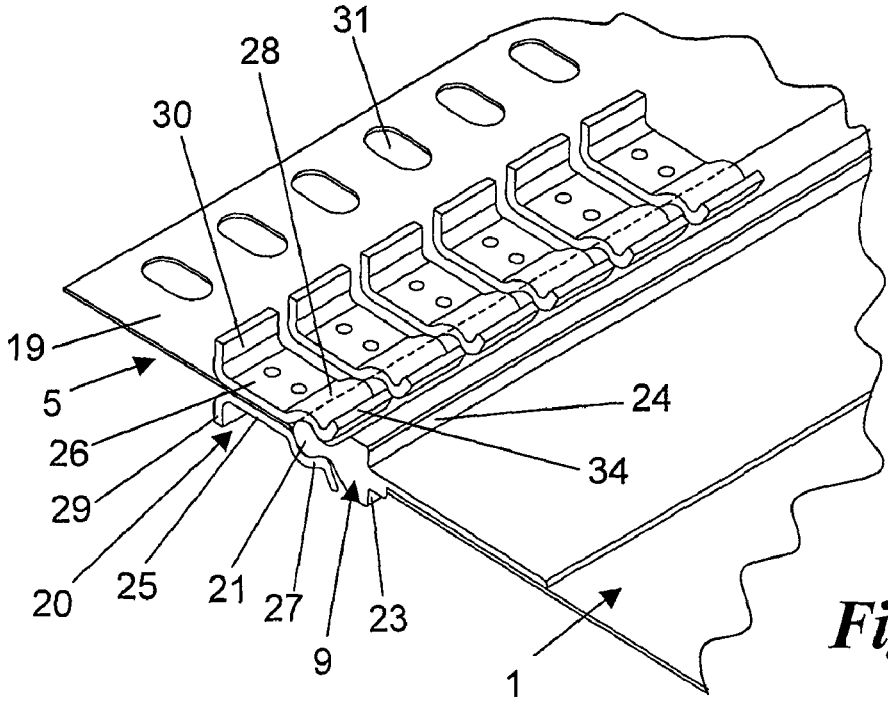
FIG. 3 is a schematic view in perspective, on a larger scale, of a part of a shutter device with transmission means, in a first specific embodiment proposed by the invention.

FIG. 3 depicts a specific embodiment of the transmission means 5 or 6. The latter comprise a continuous flexible metal strip 19 provided with hooking means by which the metal strip 19 is secured to the side edges 9 and 10 of the shutter 1. The metal strip 19 extends across the entire length of the shutter 1 in the plane thereof. The hooking means have a succession of clips 20 disposed separately from one another.

To enable them to be securely fixed to the side edges 9 and 10 of the shutter 1, said clips 20 stand proud of the plane of the shutter 1. In particular, these side edges 9 and 10 are provided with a bead 21 on which the clips 20 adapt. A thickening 22 is also provided at the side edges 9 and 10, adjacent to the bead 21 and on either side of the plane of the shutter 1, with faces 23 and 24 on its two sides perpendicular to the plane of the shutter 1. The purpose of faces 23 and 24 will be described below.

The clips 20 consist of two thin metal plates 25 and 26 mounted by means of rivets on either side of the strip 19. These thin plates 25 and 26 have a curved part 27, 28 respectively, which extends beyond the edge of the strip 19 so that the bead 21 is clamped between these thin plates. The clips 20 can be elastically deformed to enable the shutter 1 to be released from the metal strip 19 and allow the shutter 1 to be fixed back onto the latter.

Provided at the end of the thin plates 25 and 26 opposite that with the curved parts 27 and 28 are guide means to allow the transmission means, i.e. the metal strip 19, to be displaced in the longitudinal direction of guide tracks 7 and 8. In the embodiment of the invention illustrated in FIG. 3, these guide means comprise guide projections 29 and 30. Said projections 29 and 30 are formed by the ends of the thin plates 25 and 26 folded out from the plane of the metal strip 19 at a right angle.

The projections 29 and 30 are guided in a substantially continuous slit in the guide tracks 7 and 8, thereby forming a guide bar in the longitudinal direction thereof.

Along its edge opposite that directed towards the shutter 1, the metal strip 19 has a series of spaced apart recesses 31. The spacing and dimensions of the recesses 31 are such that the toothed wheel 35 is able to mesh with the metal strip 19 and displace the latter in a direction parallel with the guide tracks 7 and 8.

Figure 4:
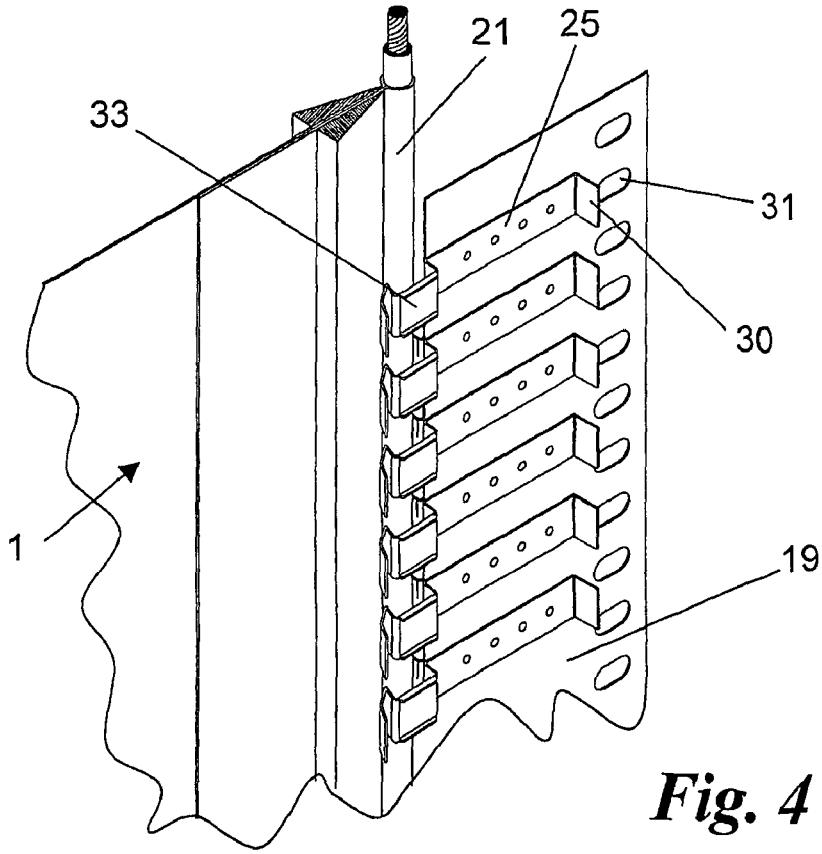
FIG. 4 is a perspective view of a part of a shutter having transmission means of a second embodiment proposed by the invention.

FIG. 4 illustrates another embodiment of the transmission means 5 or 6 of FIG. 3. These transmission means 5 or 6 are provided with hooking means in the form of a series of clips 20 comprising two thin plates 25 and 26 symmetrically positioned on either side of the metal strip 19, to which they are fixed by welding or bonding. A part of each of the thin plates 25 and 26 extends beyond the edge of the metal strip 19 and is folded back in the form of a hook so as to clamp the bead 21. The end 34 of the thin plates 25 and 26 is folded out towards the exterior, as in the design illustrated in FIG. 3, so that the bead 21 of the shutter 1 can be readily inserted back between the clips 20 if released from these clips 20.

The strips forming the side edges 9 and 10 of the shutter are provided with a thickening 22 extending along the bead 21 on either side of the plane of the strips.

Figure 5:
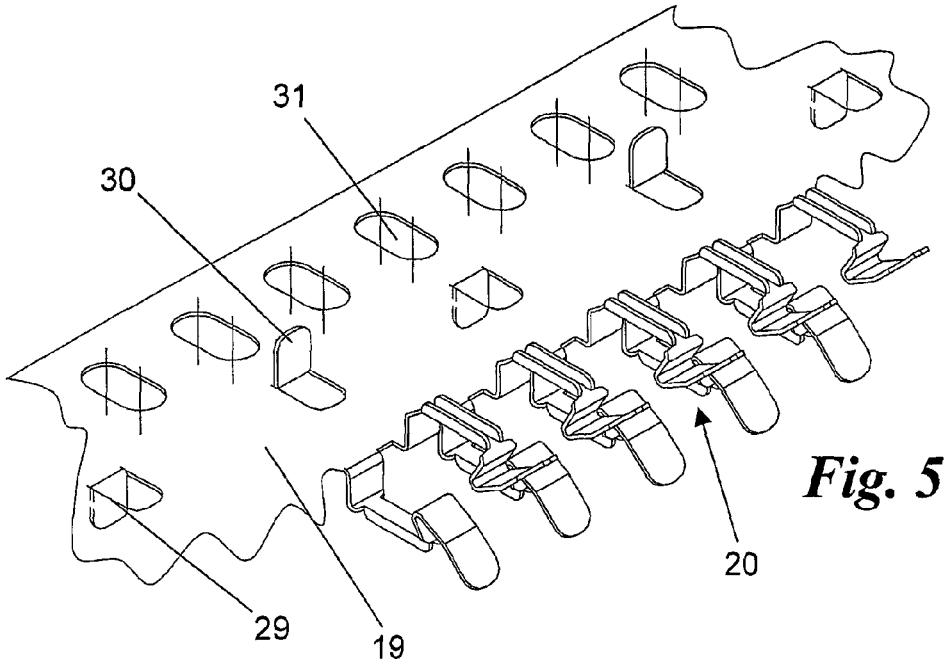
FIG. 5 is a perspective view of a part of the transmission means, representing a third specific embodiment as proposed by the invention.
Figure 6:
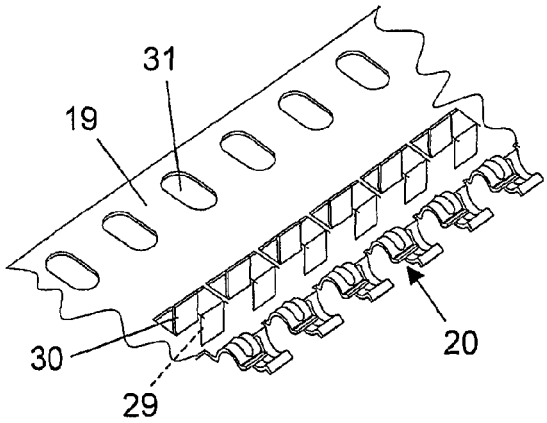
FIG. 6 is a perspective view of a part of the transmission means in a fourth practical embodiment as proposed by the invention.
Figure 7:
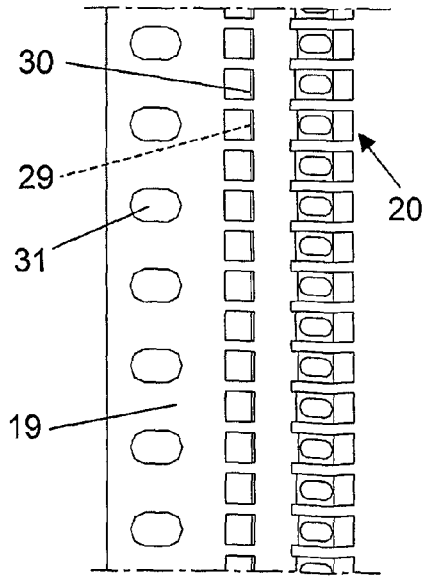
FIG. 7 is a front view of the transmission means illustrated in FIG. 6.

In FIG. 5, the transmission means 5 and 6 are provided in the form of a metal strip 19 which forms an integral unit with the clips 20. The latter are cut out by punching and are then shaped so that the thin plates extend alternately on one side of the plane of the metal strip and on the opposite side thereof. Accordingly, the thin plates located on one side of said plane are offset from those disposed on the other side of this plane. Guide projections 29 and 30 are formed in a similar manner.

The free end of the thin plates directed towards the shutter 1, not illustrated in FIG. 5, is folded towards the exterior more or less in the shape of a funnel to facilitate insertion of the bead 21 in the clips formed by these thin plates.

FIGS. 8 to 11 illustrate various embodiments of the side edges 9 and 10 of a shutter 1, in which these side edges 9 and 10 have a strip 32 which is attached to the shutter 1.

Figure 8:
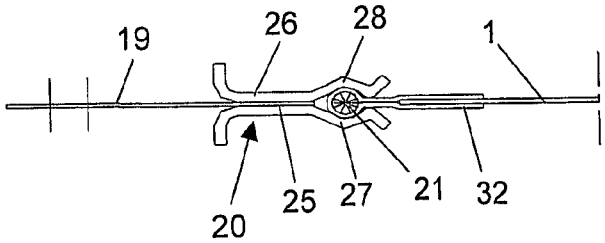
FIGS. 8 to 11 show schematic views in section of transmission means clamping an edge of a shutter, depicting different embodiments of the invention.

FIG. 8 depicts a shutter 1 having a bead 21 only and no thickening.

Figure 9:
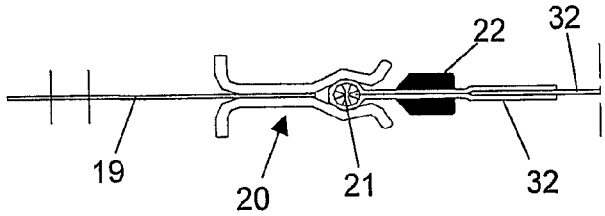

The side edges 9 or 10 of the shutter 1 illustrated in FIG. 9 have a bead 21 spaced back from the thickening 22.

Figure 10:
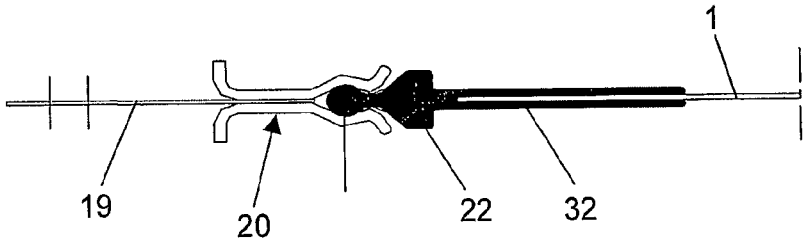
Figure 11:
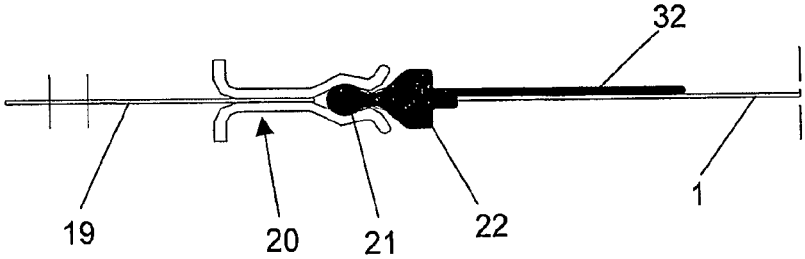

FIGS. 10 and 11 illustrate a shutter 1 with a bead 21 and a thickening 22 which are substantially the same as those illustrated in FIG. 3.

In FIG. 10, the strip 32 is fixed to both sides of the plane of the shutter 1 whilst in FIG. 11, the strip 32 is attached to only one side of the shutter 1.

FIGS. 12 to 14 illustrate a toothed wheel 35 which forms part of the driving means. The toothed wheel 35 has a central, cylindrical hole 38 for mounting on said shaft 12 and has teeth 36 spaced at a distance apart from one another around its periphery.

To ensure good meshing with the transmission means 5 or 6, the tangent 50 at the base of the teeth 36, located in the plane of symmetry of the toothed wheel 35, extends substantially radially relative to the latter. This prevents any force from being exerted by the wheel 35 on the transmission means, and in particular on the metal strip 19, the latter being radially spaced back from the toothed wheel 35. As may be clearly seen from FIG. 14, the teeth 36 have a section in the shape of a semi-ellipse.

Another embodiment of a toothed wheel proposed by the invention is illustrated in FIGS. 15 to 17. In this embodiment, the toothed wheel 35 differs from that of the preceding drawings due to the shape of the teeth 36. They are semi-ellipsoid in shape.

In order to drive the wheel 35 about its axis, a nylon boss 39 coaxial therewith is mounted against one of its lateral faces. This boss 39 is driven by the shaft 12, which co-operates with said electric motor 13.

Figure 18:
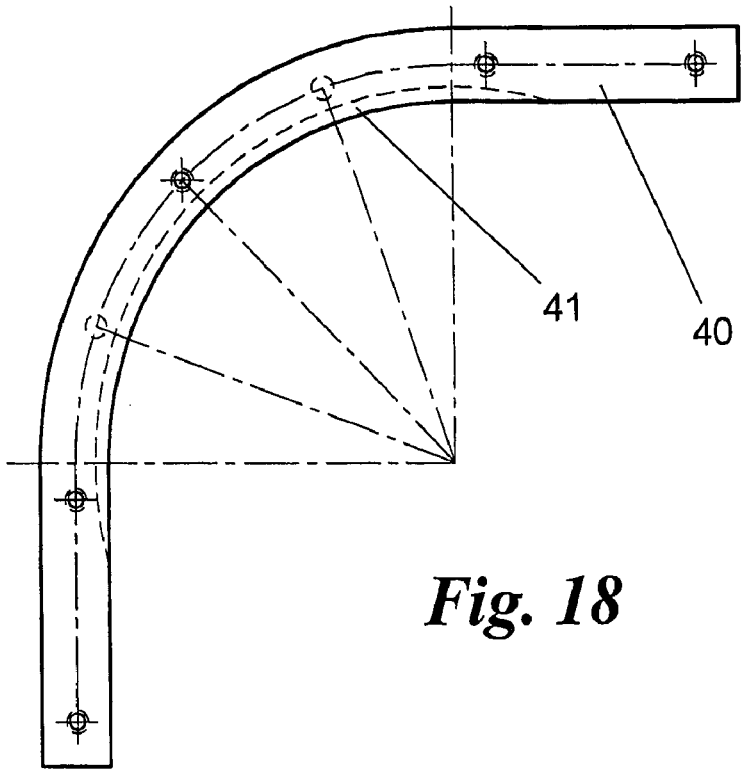
FIG. 18 is a schematic side view of an anti-jamming block as proposed by the invention.

FIG. 18 illustrates a guide block 40, being in a fixed position, which must be placed in the path of the toothed wheel 35 so as to prevent the transmission means releasing from the latter. This guide block 40 partially matches the contour of the toothed wheel 35 in shape and the side directed towards the latter is provided with a recess 41 which extends along virtually one quarter of the contour of the toothed wheel 35 and does so in such a way as to allow the teeth 36 to be displaced in this recess 41 when the toothed wheel 35 is rotated about its axis. The metal strip 19 is then displaced between this guide block 40 and the toothed wheel 35 preferably without coming into contact with the metal strip 19 strip at all. This avoids any friction between the guide block 40 and the metal strip 19.

If an obstacle comes into contact with the shutter whilst it is being opened or closed or if the shutter 1 is fully or partially closed or open, a force is exerted on the side edges 9 and 10 of the shutter relative to the metal strip, transversely to the longitudinal direction of the guide tracks. If this force is sufficiently high, the side edges 9 and 10 separate from this metal strip, at least to a certain extent, releasing said bead 21 from the clips 20.

Because the shutter 1 has been at least partially moved out of the guide tracks 7 and 8, it can not be damaged or cause a serious accident.

To re-insert the side edges 9 and 10 and thus restore the link between the transmission means 5 and 6 and the shutter 1, re-locating means 42 are provided for each of the guide tracks 7 and 8 close to the top edge of the opening 3.

Figure 19:
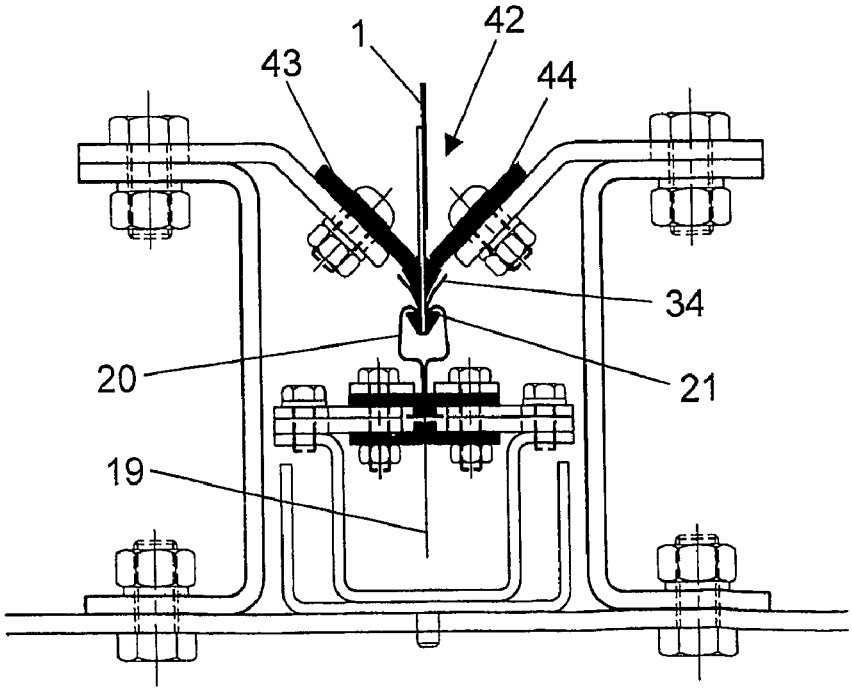
FIG. 19 is a section, on a larger scale, of the re-locating means along the line XIX—XIX of FIG. 1.

As illustrated in FIG. 19, these re-locating means 42 comprise members which enable a compression force to be exerted on the side edges 9 and 10 of the shutter 1 in a direction having a component parallel with the plane of the shutter 1 and directed towards the side edges 9 and 10 thereof.

Said members are provided in the form of two rollers 43 and 44 which are disposed so that they are able to exert sufficient compression force on a projecting part of the side edges 9 and 10 formed by said thickening 22. As a result of this compression force during opening or closing of the shutter 1, the bead 21 of the side edges 9 and 10 is applied against the free, folded back ends of the clips 20. Firstly, the bead 21 is elastically compressed and secondly the clips 20 are elastically deformed so that the bead can slip back between the projecting parts of the clips 20 under the action of the rollers 43 and 44, restoring the link between the side edges 9 and 10 and the transmission means 5 and 6.

The rollers 43 and 44 illustrated in FIG. 19 are obliquely and symmetrically disposed on either side of the plane of the shutter 1. This prevents the side edges 9 and 10 from becoming blocked between the guide tracks 7 and 8 and the rollers 43 and 44, for example. By preference, a distance of about 1 mm is maintained between the shutter 1 and the rollers 43 and 44 in order to avoid any friction between the shutter 1 and these rollers 43 and 44 as the latter is guided by the guide tracks 7 and 8 during displacement between its open and shut positions.

In certain situations, particularly if the side edges 9 and 10 of the shutter 1 are not very flexible, it is generally not necessary to provide any re-locating means. As the shutter 1 is being opened 1, the bead 21 is automatically re-introduced into the clips 20 due to the rigidity of the side edges 9 and 10 of the shutter 1.

The guide tracks 7 and 8 are designed so as to form a slide block for the transmission means 5 and 6. In the embodiment of a guide track 7 or 8 illustrated in cross section in FIG. 20, this guide track 7 or 8 comprises four substantially continuous L-shaped profiled sections 45 which are symmetrically mounted relative to the metal strip 19 of the transmission means 5 or 6.

The profiled sections 45 are disposed so as to form a free space in the shape of a cross in which the metal strip 19 provided with guide projections 29 and 30 can be displaced. In order to obtain a constant distance between the profiled sections to allow a passage for guide projections 29 and 30, a support plate 46 extending transversely to the plane of the shutter 1 is mounted between the profiled sections.

In order to maintain a constant distance between the profiled sections 45, needed in order to allow the metal strip 19 to slide between the profiled sections 45, a section 47 with a U-shaped cross section is secured to the support plates 46 by bolts 51. The part of the metal strip 19 having the recesses 31 co-operating with the driving means is located in the cavity formed by the section 47.

The profiled sections 45 are advantageously made from an electrically insulating material, such as nylon for example.

Figure 21:
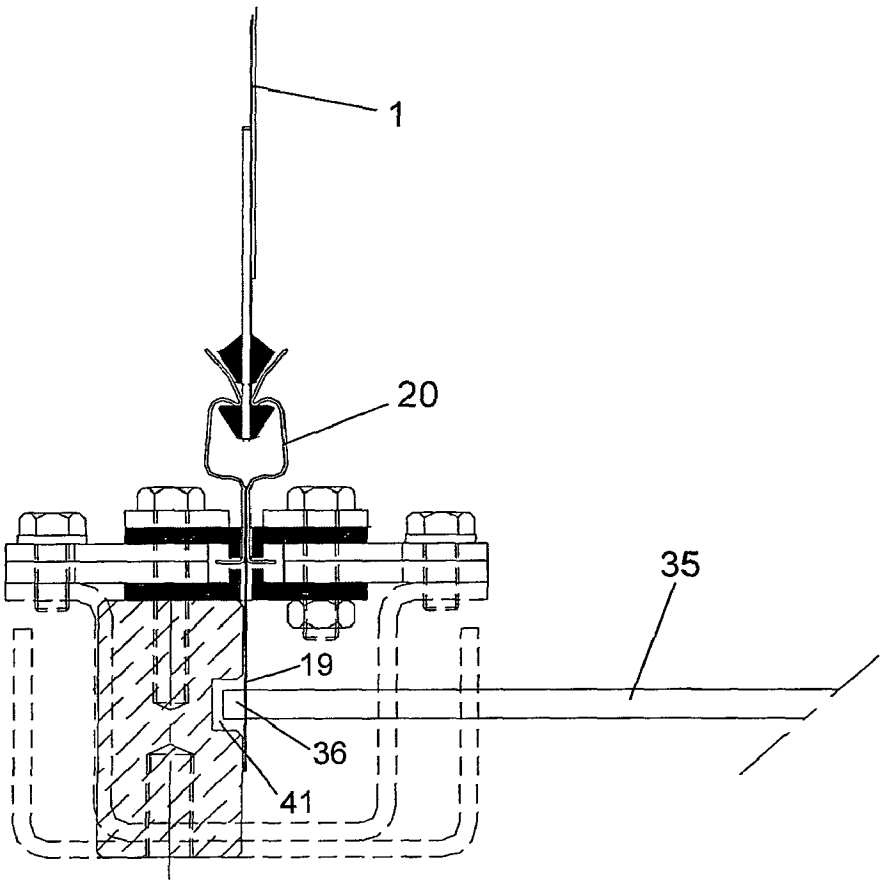
FIG. 21 is a section, on a larger scale, along the line XXI—XXI of FIG. 1.
Figure 20:
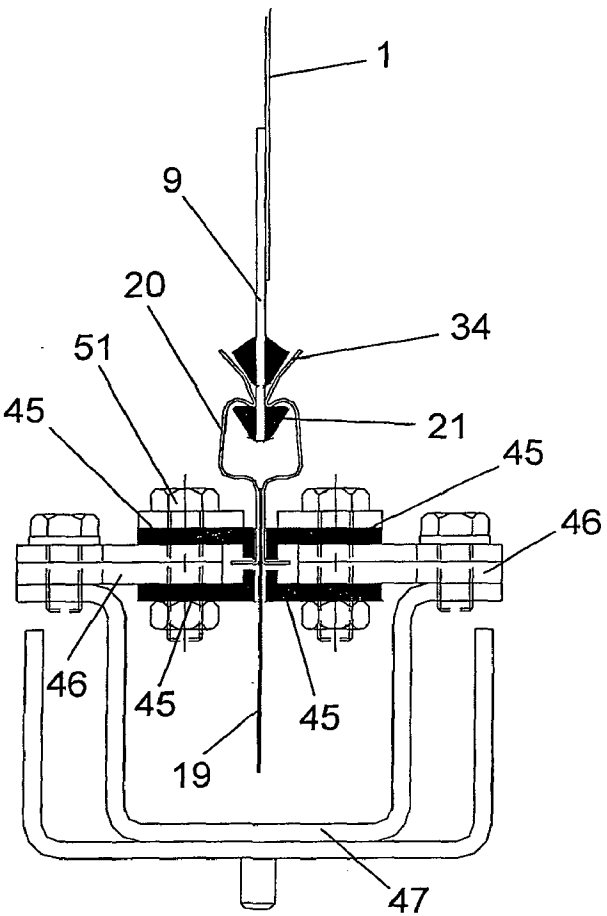
FIG. 20 is a section, on a larger scale, along the line XX—XX of FIG. 1.

FIG. 21 illustrates the guide track 7 or 8 of FIG. 20 on a level with said toothed wheel 35. As clearly illustrated in this drawing, the metal strip 19 is located between the toothed wheel 35 and the anti-jamming block 40, whilst the teeth 36 extend through the recesses 31 of the metal strip 19 into the recess 41 of the anti-jamming block 40. At this height, the section 47 is uninterrupted.

If an obstacle is underneath the shutter 1 and comes into contact with the free edge 16 of the shutter 1 as it is being closed or if the shutter 1 accidentally becomes hooked, the side edges 9 and 10 close to the free edge 16 are moved apart from the transmission means 5 and 6 and the link between the transmission means 5 and 6 and the facing 49 is interrupted.

Figure 24:
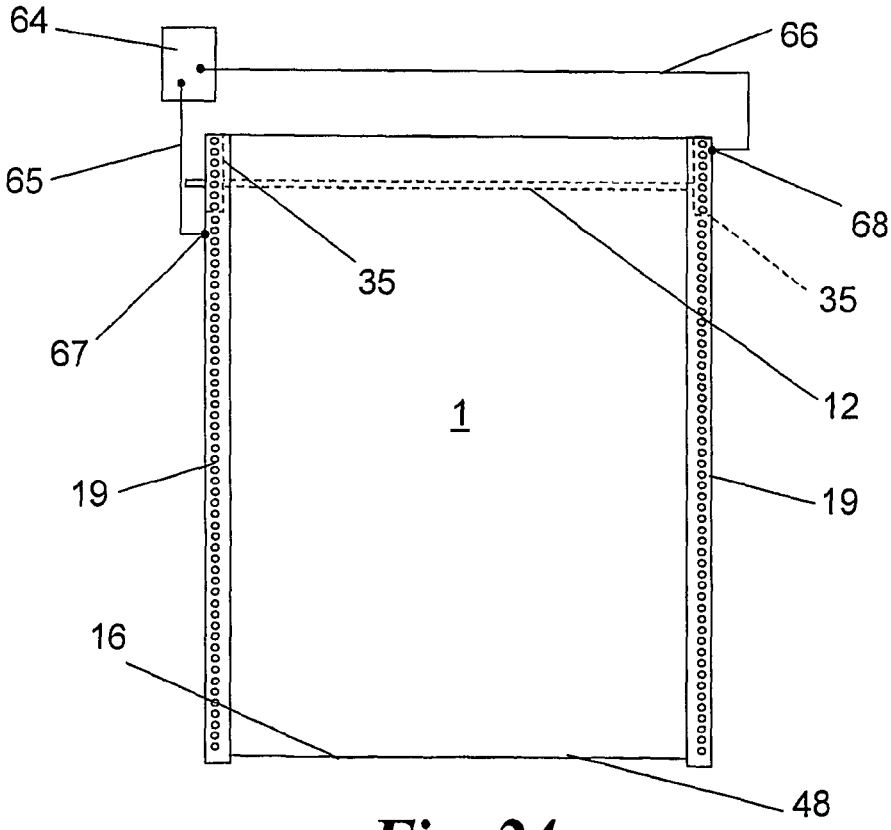
FIG. 24 is a schematic illustration of an electric circuit enabling the shutter to be halted when an obstacle is located underneath the shutter.

Accordingly, an electric circuit is established, as schematically illustrated in FIG. 24, which is connected to a control unit 64 so that when the electric circuit is broken, displacement of the shutter 1 is immediately halted.

If there is an obstacle underneath the shutter as it is being closed, such as a person, the shutter 1 is halted immediately once the free edge 16 thereof comes into contact with this obstacle and is automatically returned to its open position.

In order to ascertain whether there is such an obstacle in the opening 3, detection means are provided as illustrated in 22 and 23. These detection means comprise firstly an electric conductor 48 incorporated in the bottom edge 16 of the shutter 1 and extending across the entire width thereof so as to make contact with the transmission means 5 and 6, and secondly an electrically conductive material forming part of the transmission means and establishing said electric circuit in conjunction with the electric conductor 48.

Consequently, this electric circuit consists of the metal strips 19, the electric conductor 48 and two electric wires 65 and 66 which connect the control unit 64 to each of the metal strips 19 by contact with conductive brushes 67 and 68. The metal strips 19 are electrically isolated from the guide tracks 7 and 8 since they are guided by sections 45 which do not conduct electricity. The toothed wheels 35 are also made from a material such as nylon that does not conduct electricity. The toothed wheels 35 may optionally be made from a cylindrical-shaped metal strip enclosing a cylindrical core of nylon to avoid wear of the toothed wheel 35 and to ensure that the metal strip 19 and hence this electric circuit is electrically isolated from the other elements of the closing device.

Figure 22:
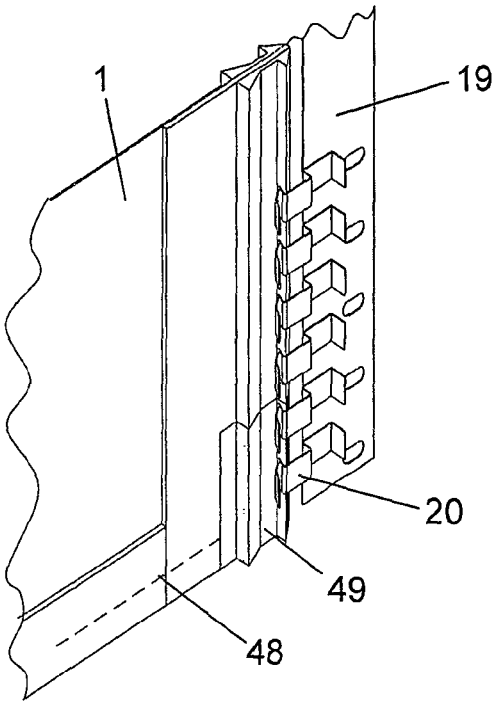
FIG. 22 is a schematic view in perspective of a part of the free edge of a shutter and a part of the transmission means clamping the free side edge of the shutter.
Figure 23:
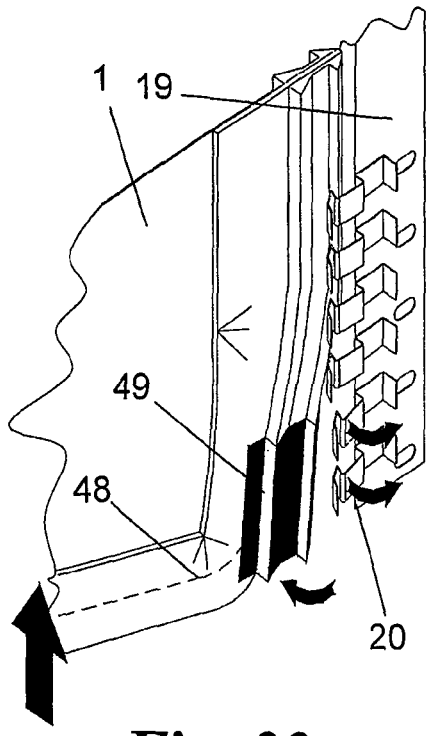
FIG. 23 is a schematic view in perspective of a part of the free edge of a shutter partially released from the transmission means.

In the embodiment illustrated in FIGS. 22 and 23, the conductive material is provided in the form of a metallic facing 49 covering the projecting side edge of the shutter 1 in the vicinity of the bottom edge 16 thereof and forming an electrical contact with the transmission means, in particular the metal strip 19.

Accordingly, the electric circuit is broken if the side edge 9 or 10 is separated from the transmission means 5 or 6 and a signal is emitted to the control unit 64 which automatically halts opening of the shutter 1 by acting on the supply or the control of the motor 13 of the driving means of the shutter 1.

The link between the hooking means, i.e. the clips 20, and the side edges 9 and 10 is preferably weaker closer to the bottom edge 16 than it is elsewhere.

FIGS. 25 to 30 provide schematic illustrations of different but not restrictive ways in which the shutter 1 is displaced from its closed position to its open position.

Figure 25:
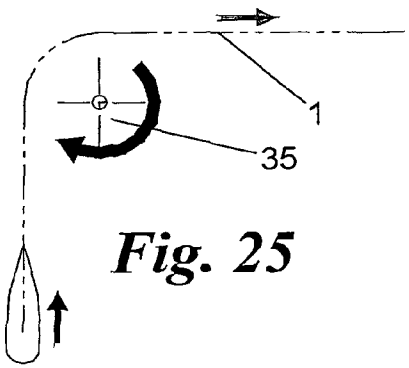
FIGS. 25 to 30 depict schematic side views of different paths along which a shutter may be displaced in accordance with the invention.

FIG. 25 illustrates the same embodiment as that shown in FIG. 1, in which the shutter 1, in its open position, extends substantially horizontally at a height located above the opening 3.

Figure 26:
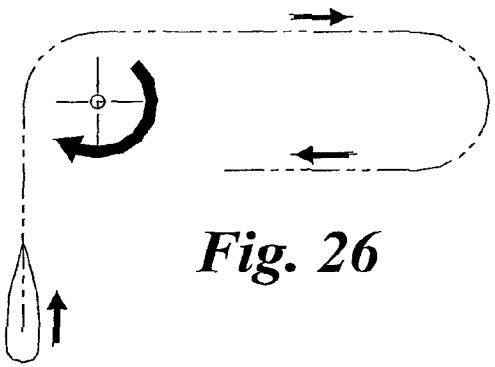

The embodiment illustrated in FIG. 26 differs from that of FIG. 25 due to the fact that in order to bring it into its open position, the shutter 1 is fed in a 180° downward return action starting from the horizontal position illustrated in 25. In another variant of this design, this 180° about-turn may be effected upwards.

Figure 27:
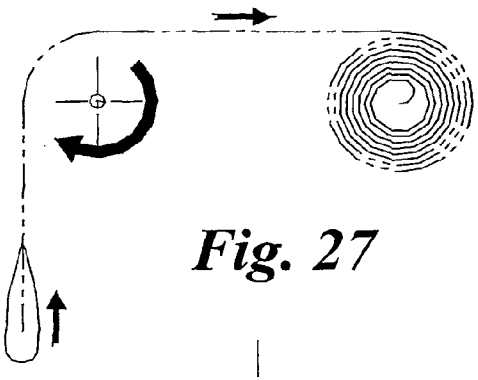

In FIG. 27, the shutter, in its open position, is wound in a spiral about a horizontal axis parallel with that of the toothed wheels of the driving means. In another variant, the winding axis may coincide with the axis of said toothed wheels. This being the case, the driving means will comprise a telescopic arm co-operating with the top end of the side edges of the shutter 1, as described in patent application WO 95/30064 (pages 11 and 12), for example.

Figure 28:
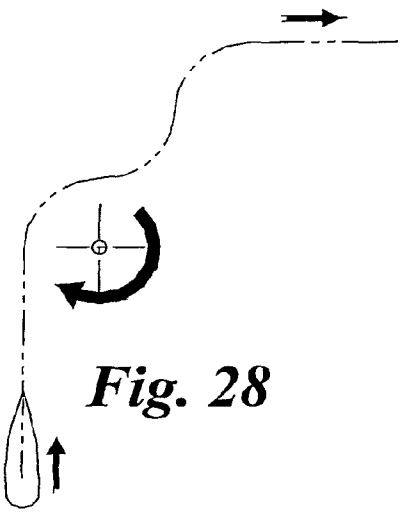

In FIG. 28, in order to pass from its closed position to its open position, the shutter 1 co-operates with the toothed wheels and is then deflected upwards followed by a horizontal displacement.

Figure 29:
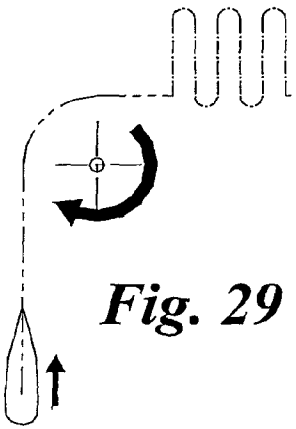

In the embodiment illustrated in FIG. 29, in its open position, the shutter 1 folds in a zigzag after co-operation with the toothed wheels.

Figure 30:
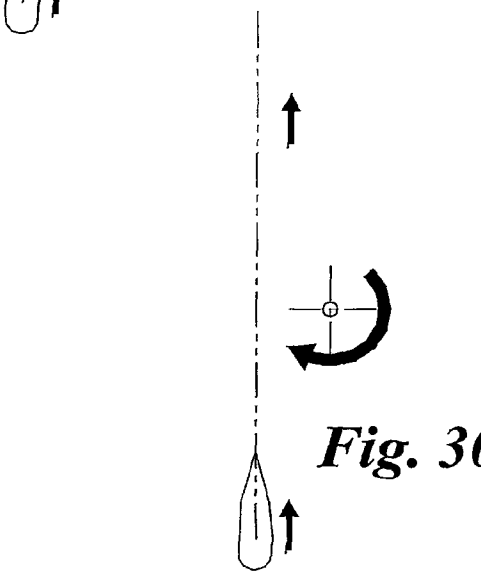
Figure 31:
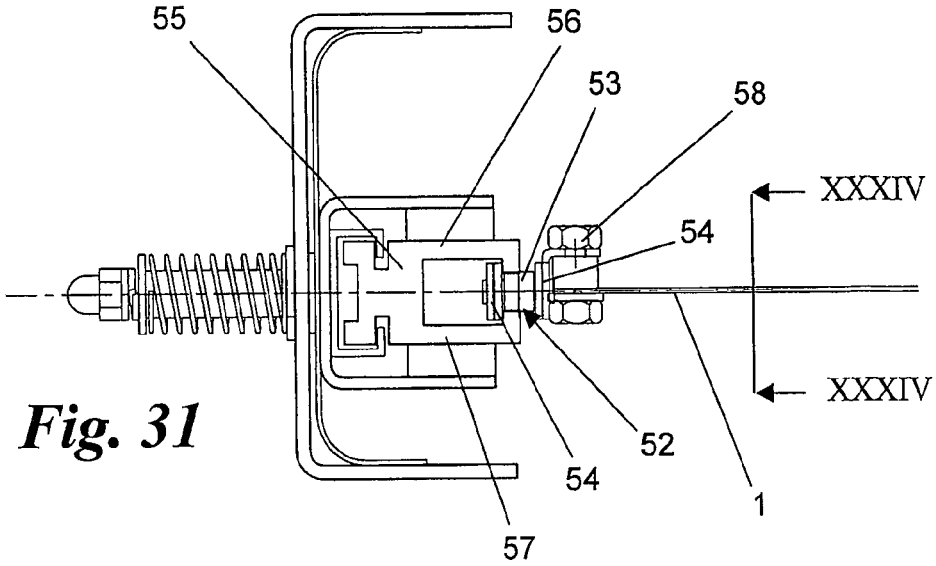
FIG. 31 is a horizontal section schematically depicting a guide track with transmission means, in a fifth embodiment as proposed by the invention.
Figure 32:
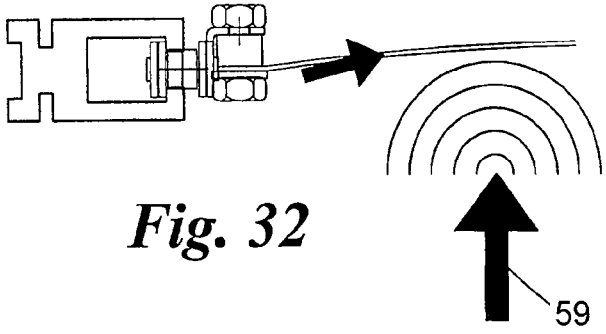
FIG. 32 is a detail from FIG. 31 in the situation where a force is being applied to the shutter a direction transverse to the plane of the latter.

Finally, in FIG. 30, the shutter 1 is moved from the closed position to its open position by a vertical displacement in its plane.

The choice of one of these solutions will depend firstly on the available options afforded by the space above the opening 3 and secondly by the nature of the shutter 1 itself.

In some instances, for example for doors with a large width, the shutter 1 and the strip 19 may fold freely in a zigzag arrangement in a box provided above the opening 3 as it is opened.

FIGS. 31 to 34 illustrate particularly practical transmission means 5 and 6 for a shutter with a large surface area. These transmission means 5 and 6 comprise a chain 52 having a succession of parallel, spaced apart bars 53 linked to one another by articulated plates 54 on the ends of these bars 53. In particular, this is a chain 52 which looks like a bicycle chain.

The guide tracks 7 and 8 incorporate a section 55 having two arms 56 and 57 with an L-shaped cross section extending along the guide tracks 7 and 8 so that a slit is formed between the ends of the arms 56 and 57 penetrated by the bars 53 such that their axis is directed substantially transversely to the direction in which the shutter 1 is displaced.

The arms 56 and 57 form a ledge against which the plates 54 bear from one side of the bars 53 to prevent the chain from being released from the section 55.

The plates 54 on the side of the shutter 1 having a ledge which extends in a plane parallel with the shutter 1 provide a means of fixing the chain 52 to the shutter 1 by bolts 58.

Figure 33:
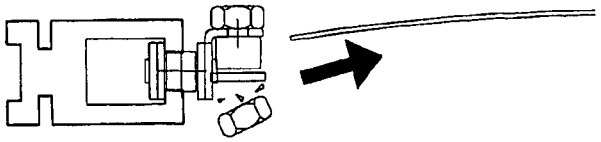
FIG. 33 shows the transmission means illustrated in FIGS. 31 and 32 when the shutter is separated from them.
Figure 34:
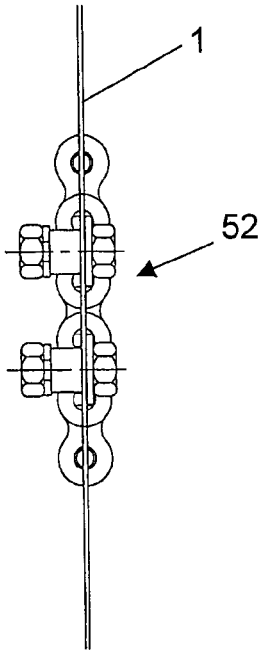
FIG. 34 is a section along the line XXXIV—XXXIV of FIG. 31.

These bolts 58 are preferably made from a material with a relatively low rigidity modulus, such as nylon, so that if a force is applied to the shutter 1 due to an obstacle coming into contact with the shutter 1 in the direction of arrow 59, the bolts 58 will break and the shutter 1 will be at least partially pulled apart from the chain 52, as illustrated in FIG. 33.

Figure 35:
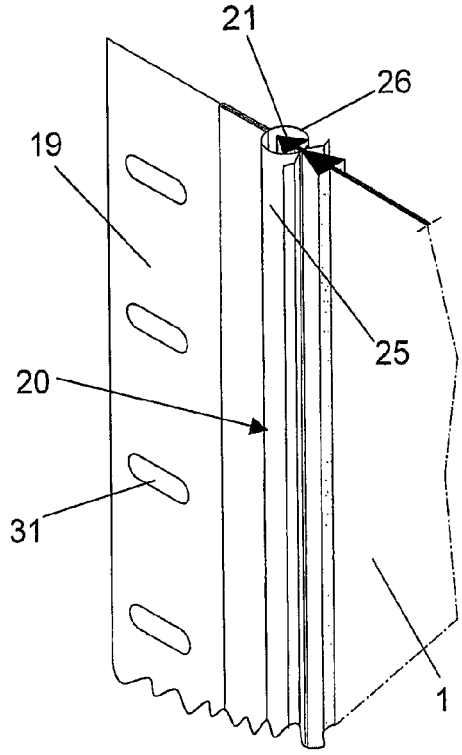
FIG. 35 is a partial schematic view in perspective of hooking means in a sixth embodiment as proposed by the invention.
Figure 36:
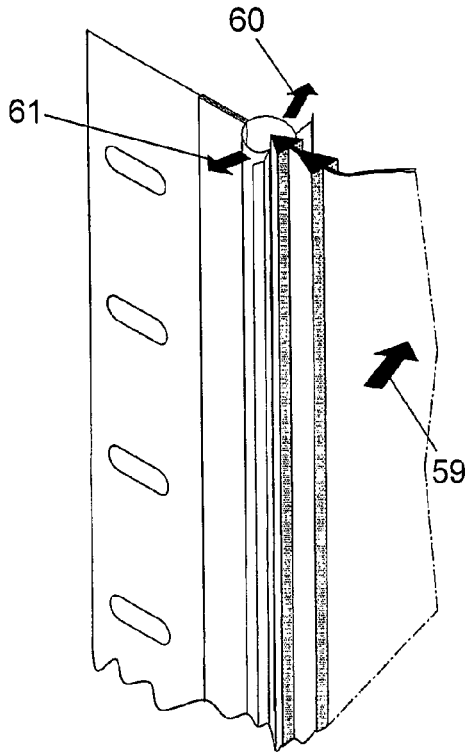
FIG. 36 illustrates the release of the shutter from the hooking means illustrated in FIG. 35.

FIGS. 35 and 36 illustrate hooking means which comprise a continuous clip 20 extending across the entire length of the side edges 9 and 10 of the shutter 1. The bead 21 has a triangular shaped section so that it can be readily clamped in the continuous clip 20.

If a traction force is exerted on the side edges 9 and 10 of the shutter, the thin plates 25 and 26 forming the clip 20 move apart as indicated by arrows 60 and 61 and the shutter 1 is separated from the clip 20.

Clearly, with this embodiment of the invention, the clips 20 are preferably flexible in the direction transverse to the plane of the shutter 1 so that the transmission means can be guided in the guide tracks 7 and 8, which are not rectilinear so as to allow a passage around curves and permit winding.

Figure 37:
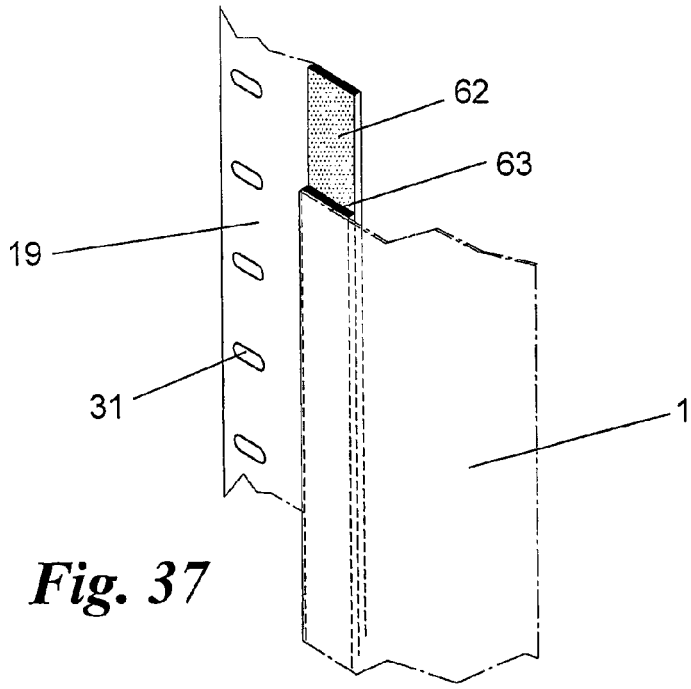
FIG. 37 is a schematic view in perspective of the hooking means in a seventh embodiment as proposed by the invention.

In the embodiment of the invention illustrated in FIG. 37, the hooking means are provided in the form of two differently woven tapes 62 and 63 which adhere to one another by contact. These tapes 62 and 63 are sold under the name of "Velcro". In other words a male tape and a female tape. One of these tapes is attached to the side edge of the shutter 1 whilst the other is joined to the metal strip 19.

This provides a removable link between the transmission means 5 and 6 and the shutter 1.

The re-locating means provided may be selected to suit whatever hooking means are used. If these hooking means consist of the tapes 62 and 63 which adhere by contact, the re-locating means might be two rollers, for example, disposed on either side of the strip 19 so that whilst the shutter 1 is being opened or closed these rollers push the tapes 62 and 63 one against the other in order to restore the link between the shutter 1 and the metal strip 19.

FIGS. 38 to 42 illustrates the successive steps by which a compressible bead 21 with a triangular section is deformed when the shutter 1 separates from the clips 20.

FIGS. 43 to 47 illustrate the successive steps by which a T-shaped side edge 9 and 10 deforms when the shutter 1 is separated from the transmission means. As the side edge retracts from the clips 20, the two T-shaped arms are folded one against the other, thus allowing it to be readily released.

FIGS. 48 to 50 illustrate the successive steps by which the clips 20 are deformed as the shutter 1 is separated from the transmission means in the situation where the latter are substantially elastic and the bead 21 is substantially incompressible.

In the situation illustrated in FIGS. 51 to 54, the clips 20 and the bead 21 are made from an elastic material so that they are able to deform elastically when the shutter 1 separates from the transmission means.

In order to ensure that the shutter 1 is kept taut between the guide tracks 7 and 8 and make allowance for manufacturing and mounting tolerances without separating from the transmission means, it is preferably fixed to the transmission means by an elastic fit.

Figure 55:
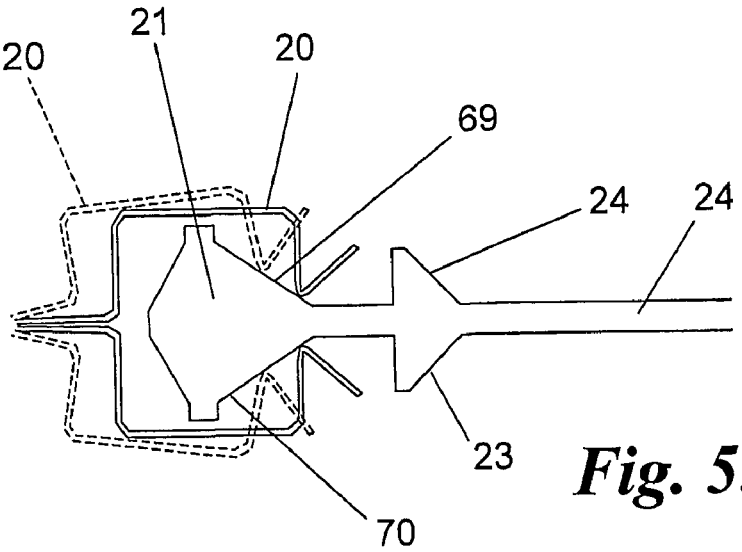
FIG. 55 illustrates a specific bead with a clip.

In FIG. 55, the bead 21 is provided at the side edges 9 and 10 of the shutter 1 and has a face 69 and 70 on either side of the latter which is inclined relative to the plane of the shutter 1 so as to form a corner. The clips 20 are supported against these faces 69 and 70. When the side edges 9 or 10 of the shutter 1 are displaced by a certain distance due to a force exerted on the latter, the clips 20 slide on the faces 69 and 70 of the bead 1 without the shutter 1 coming out of the clips 20, provided this force is not great enough to cause the clips 20 to come apart from the shutter 1. This situation is illustrated by a clip 20 shown by broken lines. Once this force is no longer acting on the shutter 1, the clips 20 are guided by the faces 69 and 70 towards the shutter 1 and stretch it.

Figure 56:
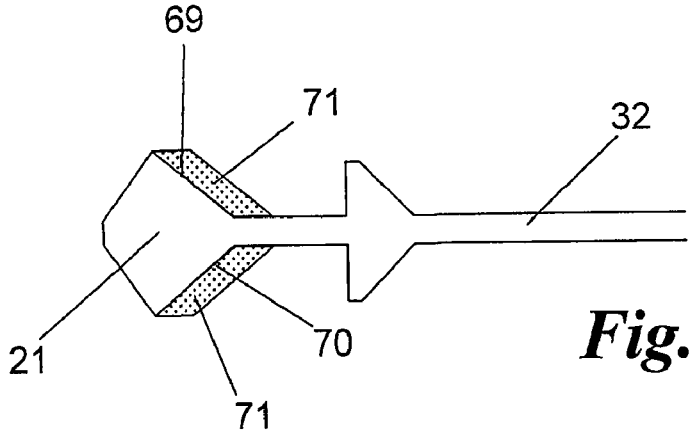
FIG. 56 illustrates another bead provided with an elastic covering.

Another variant of the bead of FIG. 55 is illustrated in FIG. 56. In this drawing, the bead 21 also has two faces 69 and 70 inclined at an angle to the plane of the shutter 1. These faces 69 and 70 are covered with an elastically compressible material 71 so that the shutter 1 always remains taut when linked to the clips 20 due to the elastic deformation of this material 20, which might be rubber, for example.

Figure 57:
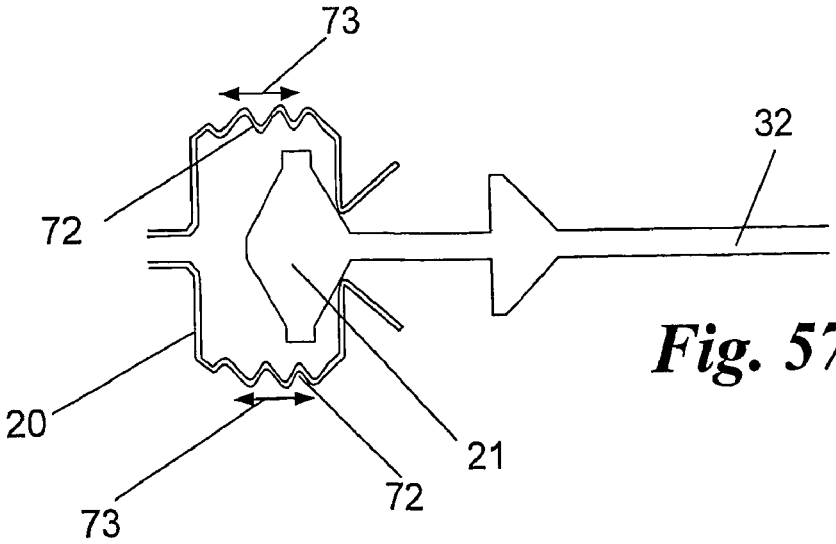
FIG. 57 illustrates a bead with a clip, which is provided with a spring.

In FIG. 57, a part of the clips 20 is shown in the form of a spring 72 which can be elastically deformed in the direction of arrow 73 to enable the shutter 1 to be held taut.

Figure 58:
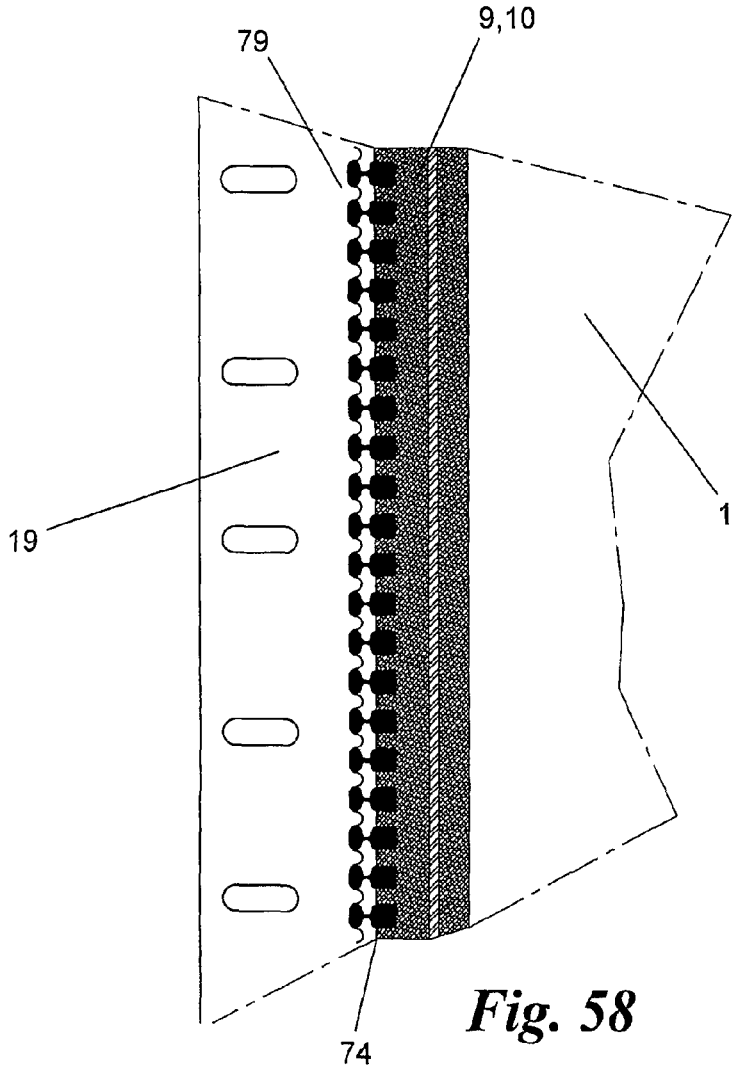
FIG. 58 is a front view of a very practical embodiment of the transmission means with a shutter as proposed by the invention.

The hooking means are not necessarily clips. In FIG. 58 for example, the shutter 1 has a succession of small separate blocks 74 at the side edges 9 and 10, preferably linked to one another in a flexible manner. These blocks 74 are formed by "teeth" of a conventional zip fastener, for example.

Figure 59:
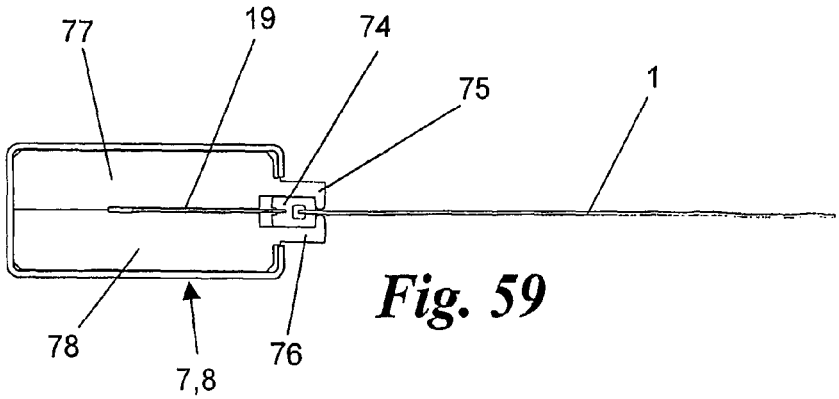
FIG. 59 is a cross section of the transmission means and the shutter illustrated in FIG. 58 with specific guide tracks, as proposed by the invention.

As illustrated in FIG. 59, each of the guide tracks 7 and 8 comprises two longitudinal sections 77 and 78 with a rectangular cross section. These sections are provided with ledges 75 and 76 extending on either side of the side edges 9 and 10 of the shutter 1. These ledges 75 and 76 are directed towards one another so that they partially enclose the small blocks 74.

A metal strip 19 is provided, which may co-operate with driving means having hooking means in the form of a toothed edge 79. As illustrated in 58, this toothed edge meshes with the succession of small blocks 74 fixed to the side edges 9 and 10 of the shutter 1.

The metal strip 19 is guided in a matching recess provided between the sections 77 and 78 and is driven by a toothed wheel 35, not illustrated in 58 and 59.

If a certain traction force is exerted on the side edges 9 and 10 of the shutter 1 transversely to the guide tracks 7 and 8, the latter separates from the metal strip 19 by releasing the blocks 74 from the guide tracks 7 and 8 due to the elastic deformation of the ledges 75 and 76.

A re-locating system similar to that described in patent EP 0 272 733 may be provided in order to re-insert the blocks 74 in the guide tracks 7 and 8.

Figure 60:
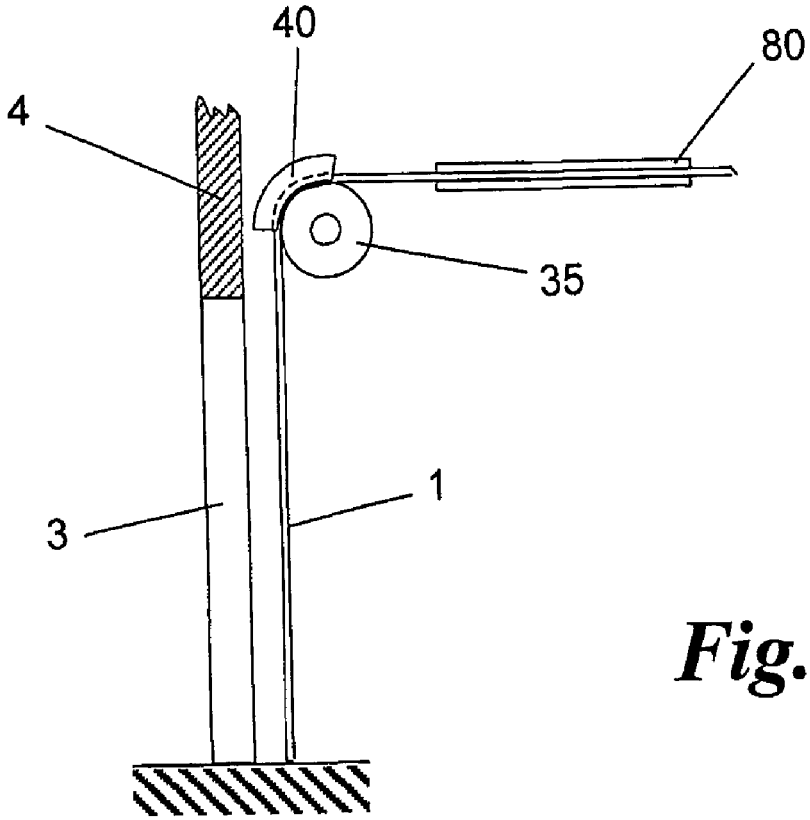
FIG. 60 is a schematic side view in section of a shutter device fitted with a rigid plate in one specific embodiment as proposed by the invention.

FIG. 60 illustrates a closure device in which only one toothed wheel is provided in one of the two guide tracks 7 or 8. For the sake of clarity, these guide tracks are not shown in the drawing.

In this embodiment of the invention, the shutter 1 is provided with a rigid plate 80 which extends across the entire width of the shutter 1 and which is permanently joined to the metal strips 19 of each of the side edges 9 and 10 of the shutter 1.

When an opening 3 is closed off by the shutter 1, the rigid plate 80 remains above the guide block 40 and the toothed wheel 35.

Figure 61:
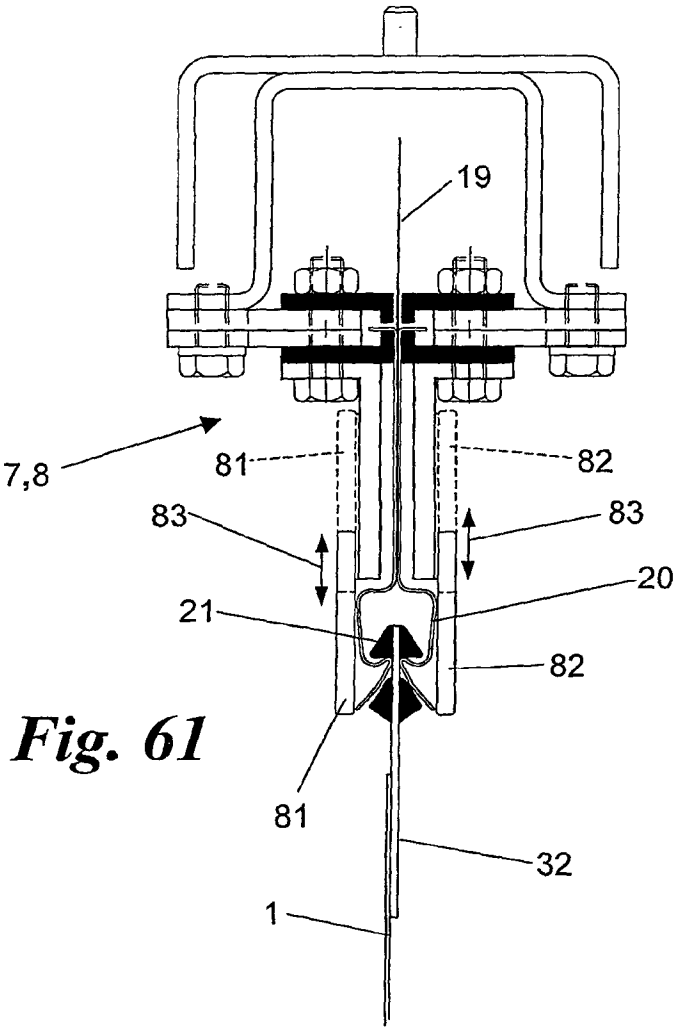
FIG. 61 is a cross section of guide track, as proposed by the invention, provided with a locking system.
Figure 63:
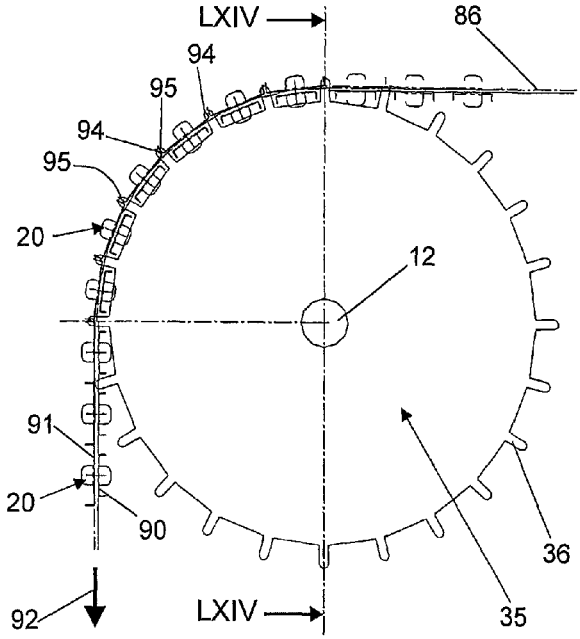
FIG. 63 is a schematic front view of a toothed wheel with transmission means as proposed by the invention.
Figure 64:
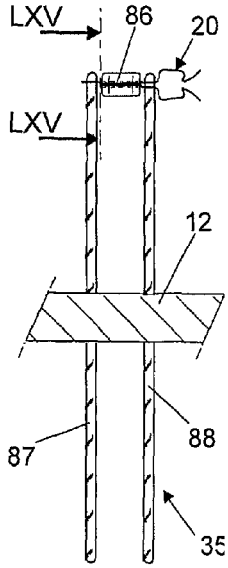
FIG. 64 is a section through the toothed wheel and transmission means along line LXIV—LXIV of FIG. 63.
Figure 65:
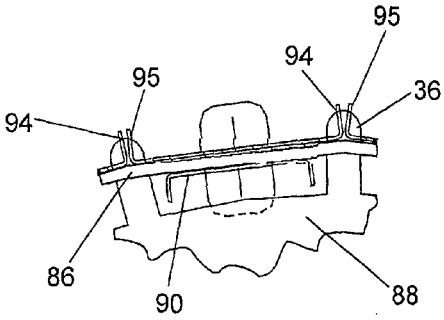
FIG. 65 is a section, on a larger scale, along the line LXV—LXV of FIG. 64.
Figure 66:
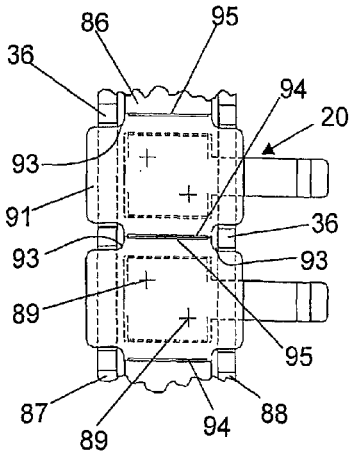
FIG. 66 is a detailed schematic view of a part of the transmission means and the toothed wheel as proposed by the invention.

FIG. 61 illustrates a locking system comprising two bars 81 and 82 extending parallel with the guide tracks 7 and 8, which can be displaced in the direction of arrows 83 between a non-locked position illustrated by broken lines and a locked position illustrated by solid lines. In the locked position, the bars 81 and 82 extend along the side edges 9 and 10 of the shutter 1 so that the clips 20 are trapped between these bars 81 and 82 preventing the bead 21 of the shutter 1 from coming loose from the clips 20.

Figure 62:
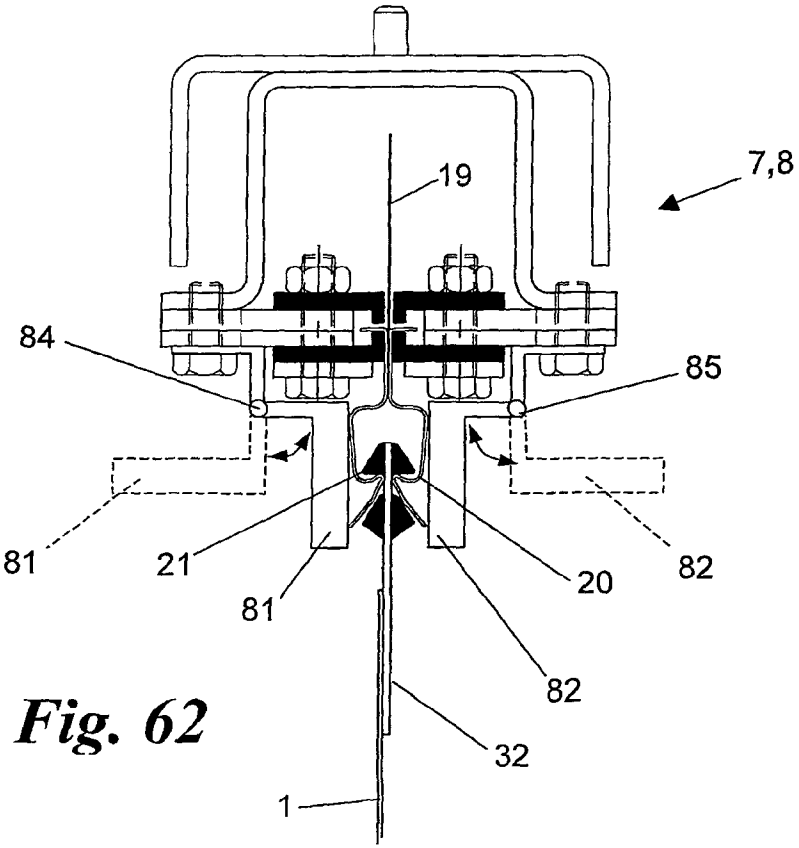
FIG. 62 is a cross section of a guide track, as proposed by the invention, fitted with a different locking system.

FIG. 62 illustrates another variant of the locking system in which the bars 81 and 82 are able to pivot about an axis 84 and 85 between a non-locked position and a locked position.

The bars 81 and 82 may be manually or automatically locked when the opening 3 is closed off by the shutter 1.

FIGS. 63 to 66 illustrate a particularly practical embodiment of the invention. In this embodiment, the transmission means consist of a flexible tape 86, such as a textile strap, provided with a succession of clips 20 which can be fixed to the side edges of a shutter 1, not illustrated in the drawings.

The tape 86 is driven via the clips 20 by means of a toothed wheel 35 having two pulleys wheels 87 and 88 mounted in parallel at a certain distance from one another on a common rotation shaft 12 and provided with teeth 36.

The clips 20 have two rigid plates 90 and 91 applied on either side against the flexible tape 86 by means of rivets 89. The plates 90 directed towards the toothed wheel 35 are spaced apart from one another by a sufficient distance to allow the tape 86 to bend against at least a part of the periphery of this toothed wheel 35.

The rigid plates 91 directed towards the opposing side of the toothed wheel 35, are freely supported one against the other as the flexible tape 86 is guided in the straight guide tracks. Accordingly, a thrust force can be applied to the flexible tape 86 in the direction of arrow 92 by rotating the toothed wheel 35 in order to close off an opening by the shutter 1 which is fixed to the clips 20.

The edges 94 and 95 of the plates 91 extend between the pulley wheels 87 and 88 and are folded transversely to the plane of these plates. The lateral sides of the edges thus formed are then supported one against the other as the shutter 1 is closed.

The rigid plates 91 directed towards the opposing side of the toothed wheel 35 are greater in width than the distance between the pulley wheels 87 and 88 of the toothed wheel 35, whilst the rigid plates 90 and the flexible tape 86 are of a width smaller than this distance. So that the teeth 36 are able to co-operate with them, the rigid plates 91 have a recess 93 at each corner in which the teeth 36 can mesh.

It is clear that the plates 90 directed towards the toothed wheel 35 need not necessarily be rigid. In a variant of this embodiment of the invention, the clips 20 may in the form of a single rigid plate 91 fixed to the side of the flexible tape 86 remote from the toothed wheel 35.

It should be pointed out that the invention is not restricted to the various embodiments described above and other variants would also be conceivable without departing from the scope of the present invention, in particular as regards the transmission and driving means, as well as the structure of the shutter and re-locating system.

Accordingly, in certain instances, if the shutter is made from a flexible material, stiffening or weighting bars could be incorporated in the shutter.

Furthermore, the guide tracks 7 and 8 need not necessarily be entirely straight and may be curved.

Moreover, the shutter device proposed by the invention is not restricted to doors with vertical guide tracks but may also have horizontal guide tracks. In certain cases, it would be possible to provide only one horizontal guide track on the top part of an opening, in which case the shutter would be suspended from this guide track.

The shutter of the device may be closed from the bottom rather than the top if the guide tracks extend vertically.

The hooking means may be of very different designs. For example, it would be possible to provide clips on the side edges of the shutter rather than on the metal strip. The clips may also be replaced by strips made up of magnets. Moreover, the bead 21 need not necessarily be continuous but may be provided in the form of a series of small block for example.

In practice, the invention covers any shutter device in which detachable transmission means are provided between the shutter and the guide tracks. The transmission means do not necessarily incorporate a metal strip; this strip could in effect be made from any other sufficiently strong material, be it flexible or rigid.

The invention claimed is:

1. Shutter device comprising one or more guide tracks (7,8) having a longitudinal direction, transmission means (5,6) and a shutter (1) with side edges (9,10), the device being designed to close off an opening (3), or any other aperture, by displacing the shutter (1) relative to the one or more guide tracks (7,8), whereby said transmission means (5,6) cooperate with the guide tracks (7,8), and are displaceable in the longitudinal direction of the guide tracks, are connected directly to and between the respective side edges (9,10) of the shutter (1) and the guide tracks (7,8) such that when a certain force is exerted on the side edges (9, 10) of the shutter (1) in a direction transverse to the longitudinal direction of the guide tracks (7,8), the side edges (9,10) are separated at least partially from the transmission means (5,6), whereby the transmission means comprise a substantially continuous strip (19) extending substantially along the entire length of the side edges (9,10) of the shutter (1).

2. Device as claimed in claim 1, whereby the transmission means (5,6) have hooking means (20) by which they are removably fixed to the side edges (9,10) of the shutter (1).

3. Device as claimed in claim 2, whereby the hooking means have a succession of clips (20) which are separate from one another.

4. Device as claimed in claim 2, whereby the hooking means have a substantially continuous clip (20) removably clamping the side edges (9,10) of the shutter (1).

5. Device as claimed in any one of claims 2 to 4, whereby the hooking means have compression members which are elastically applied on either side of the side edges (9,10) of the shutter (1).

6. Device as claimed in any one of claims 2 to 4, whereby the hooking means (20) and the side edges (9,10) of the shutter are linked more weakly to each other close to the bottom edge (16) thereof than at other points.

7. Device as claimed in any one of claims 1 to 4, whereby the shutter (1) has side edges (9,10) protruding out of the plane of the shutter (1).

8. Device as claimed in one of claims 1 to 4, whereby the transmission means (5,6) are provided with a succession of recesses (31) spaced apart in the direction of displacement of the shutter (1) which co-operate with driving means (35,36) enabling the shutter (1) to be displaced in a direction parallel with the guide tracks (7,8).

9. Device as claimed in claim 8, whereby the driving means comprise a toothed wheel (35), the teeth (36) of which are spaced apart from one another so as to be able to co-operate with said recesses (31).

10. Device as claimed in claim 9, whereby the tangent (50) at the base of the teeth (36) located in the plane of symmetry of the toothed wheel (35) intersects the axis of rotation of the latter.

11. Device as claimed in claim 8, whereby a fixed anti-jamming block (40) is provided, which extends at least partially around the driving means (35,36) in order to prevent the transmission means (5,6) from being released from the driving means (35,36).

12. Device as claimed in any one of claims 1 to 4, whereby re-locating means (42) are provided in order to restore the link between the transmission means (5,6) and the shutter (1) when the shutter (1) is being opened or closed if the latter has become separated from the transmission means (5,6), these re-locating means (42) comprising members (43,44) enabling a compression force to be exerted on the side edges (9,10) of the shutter in a direction having a component parallel with the plane of the shutter (1) and directed towards the side edge (9,10) thereof.

13. Device as claimed in claim 12, whereby said members have at least one roller (43,44) which is mounted so that it can exert a compression force towards the transmission means (5,6) on a corresponding projecting part of the side edge (9,10) of the shutter (1) if it has become separated from the transmission means (5,6).

14. Device as claimed in claim 13, whereby the relocating members have two rollers (43,44) which are disposed on either side of the plane of the shutter (1), preferably symmetrically.

15. Device as claimed in any one of claims 1 to 4, whereby the transmission means (5,6) have guide means (30) co-operating with the guide tracks (7,8) so that the transmission means (5,6) can be displaced in the longitudinal direction of the guide tracks (7,8).

16. Device as claimed in claim 15, whereby the guide means have projections (30) which are guided in a substantially continuous slit in the guide tracks (7,8), thereby forming a slide block in the longitudinal direction thereof.

17. Device as claimed in claim 16, wherein said transmission means lie in a plane, and said projections (30) extend on either side of the plane of the transmission means (5, 6).

18. Device as claimed in any one of claims 2 to 4, whereby detection means (48,49, 64) are provided which emit a signal if the link between the hooking means (20) and the side edges (7,8) of the shutter (1) is broken.

19. Device as claimed in claim 18, whereby the detection means have electric conductors (48) forming part of an electric circuit and connecting the transmission means (5,6) to the corresponding side edges (9,10) of the shutter (1) close to the free edge (16) thereof so that an electric signal is emitted if the link between the hooking means (20) and one of the side edges (9,10) is broken close to the free edge (16) of the shutter (1).

20. Device as claimed in any one of claims 1 to 4, whereby said continuous strip (19) is made from a flexible, non-rigid material extending substantially in the plane of the shutter (1).

21. Device as claimed in any one of claims 2 to 4, whereby the side edges (9,10) of the shutter (1) have a bead (21) to which the hooking means (20) adapt.

22. Device as claimed in one of claims 2 to 4, whereby the transmission means (5,6) comprise a substantially continuous flexible tape (86) extending substantially in the plane of the shutter (1) and substantially across the entire length of the side edges (9,10) thereof, this flexible tape (86) being provided with hooking means having a succession of rigid elements (91) which can be freely supported one against the other.

23. Device as claimed in claims 20, whereby the transmission means (5,6) are made from a metal strip.

* * * * *